US011790819B2

(12) United States Patent
Hu et al.

(10) Patent No.: US 11,790,819 B2
(45) Date of Patent: Oct. 17, 2023

(54) COMPENSATION METHOD AND ELECTRONIC DEVICE

(71) Applicant: Huawei Technologies Co., Ltd., Shenzhen (CN)

(72) Inventors: Kai Hu, Xi'an (CN); Weibo Hou, Xi'an (CN); Xiao Xiao, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 17/640,649

(22) PCT Filed: Sep. 4, 2020

(86) PCT No.: PCT/CN2020/113571
§ 371 (c)(1),
(2) Date: Mar. 4, 2022

(87) PCT Pub. No.: WO2021/043280
PCT Pub. Date: Mar. 11, 2021

(65) Prior Publication Data

US 2022/0358864 A1 Nov. 10, 2022

(30) Foreign Application Priority Data

Sep. 6, 2019 (CN) ..... 201910844673.8

(51) Int. Cl.
*G09G 3/00* (2006.01)
*G09G 3/32* (2016.01)

(52) U.S. Cl.
CPC ..... *G09G 3/035* (2020.08); *G09G 3/32* (2013.01); *G09G 2320/0233* (2013.01); *G09G 2320/046* (2013.01)

(58) Field of Classification Search
CPC ..... G09G 3/035; G09G 3/32
(Continued)

(56) References Cited

U.S. PATENT DOCUMENTS

2012/0079353 A1* 3/2012 Liikanen ..... H03M 13/41 714/E11.034
2013/0251361 A1* 9/2013 Azadeh ..... H04B 10/40 398/25

(Continued)

FOREIGN PATENT DOCUMENTS

CN 107170424 A 9/2017
CN 107248392 A 10/2017

(Continued)

OTHER PUBLICATIONS

Ma Jingyi ; Display method and device, electronic equipment and medium; Mar. 12, 2019; Oppo Guangdong Mobile Telecommunications Co Ltd CN109461406 (A)—Display method and device, electronic equipment and medium Figures 1-7, paragraphs 56-191 English.*

(Continued)

*Primary Examiner* — Prabodh M Dharia
(74) *Attorney, Agent, or Firm* — Conley Rose, P.C.

(57) ABSTRACT

A compensation method includes that an electronic device determines, based on statistical data of a first display and a first correspondence, a first actual value of a to-be-measured parameter of the first display at the end of a first statistical period; determines, based on statistical data of a second display and a second correspondence, a second actual value of a to-be-measured parameter of the second display at the end of the first statistical period; determines a compensation target value based on the first actual value and the second actual value when the first actual value is less than the second actual value; and writes the compensation target value into a first register configured to control the to-be-measured parameter of the first display, and writes the compensation target value into a second register configured (Continued)

to control the to-be-measured parameter of the second display.

20 Claims, 6 Drawing Sheets

(58) Field of Classification Search
USPC ..... 345/84
See application file for complete search history.

(56) References Cited

U.S. PATENT DOCUMENTS

| | | | | |
|---|---|---|---|---|
| 2017/0042002 | A1 | 2/2017 | Asamura et al. | |
| 2018/0158404 | A1 | 6/2018 | Li | |
| 2020/0322243 | A1* | 10/2020 | Xi | H04L 47/196 |
| 2021/0282656 | A1* | 9/2021 | Li | A61B 5/1495 |
| 2021/0327328 | A1* | 10/2021 | Liu | G09G 3/20 |

FOREIGN PATENT DOCUMENTS

| | | | |
|---|---|---|---|
| CN | 108257579 | A | 7/2018 |
| CN | 109036271 | A | 12/2018 |
| CN | 109088989 | A | 12/2018 |
| CN | 109461406 | A | 3/2019 |
| CN | 109981843 | A | 7/2019 |
| CN | 110164398 | A | 8/2019 |
| CN | 110177174 | A | 8/2019 |
| CN | 110808003 | A | 2/2020 |
| EP | 2993661 | A1 | 3/2016 |
| WO | 2019141116 | A1 | 7/2019 |

OTHER PUBLICATIONS

Ma Jingyi ; Display method and device, electronic equipment and medium; Mar. 12, 2019; Oppo Guangdong Mobile Telecommunications Co Ltd CN109461406 (A)—Display method and device, electronic equipment and medium Figures 1-7, paragraphs 56-191 Chinese.*

* cited by examiner

COMPENSATION METHOD AND ELECTRONIC DEVICE

CROSS-REFERENCE TO RELATED APPLICATIONS

This is a U.S. National Stage of International Patent Application No. PCT/CN2020/113571 filed on Sep. 4, 2020, which claims priority to Chinese Patent Application No. 201910844673.8 filed on Sep. 6, 2019. Both of the aforementioned applications are hereby incorporated by reference in their entireties.

TECHNICAL FIELD

This application relates to the field of terminal technologies, and in particular, to a compensation method and an electronic device.

BACKGROUND

With popularization of electronic products, electronic devices such as mobile phones and computers are increasingly more commonly used in people's lives, and displays of the electronic devices are also made increasingly larger. To facilitate portability, electronic devices with foldable displays also appear subsequently.

To provide better display experience for a user, currently, an organic light-emitting diode (organic light emitting diode, OLED) is widely used in a display due to characteristics such as self-illumination, high luminance, a wide viewing angle, a fast response, and RGB full-color components that can be manufactured. The OLED uses an electroluminescent characteristic of an organic material to emit light, and the organic material has a life limit. Therefore, as a use time of the display increases, a problem of material depletion and aging may occur. For example, when same and static images are displayed at some fixed positions of the display for a long time, organic materials corresponding to sub-pixels at these positions are more severely consumed than organic materials corresponding to subpixels at other positions. However, attenuation speeds of organic materials corresponding to different subpixels (R pixels, G pixels, and B pixels) are inconsistent, or use duration of various areas of the display is inconsistent, causing a problem of uneven aging degrees on the display. In particular, materials of blue subpixels have a shorter attenuation period and severer aging. Similarly, an LCD may also have such a problem of inconsistent aging degrees. When the LCD, the OLED, and the like are applied to an electronic device with a foldable display, and when the electronic device with the foldable display is in a folded state, use duration of various displays used by the user is inconsistent. When the display is fully unfolded, it is found that display effects of various displays greatly vary due to uneven aging degrees.

SUMMARY

This application provides a compensation method and an electronic device, to reduce a difference between to-be-measured parameters of various displays of the electronic device, so that display effects of different displays are consistent.

According to a first aspect, an embodiment of this application provides a compensation method. The method is applied to an electronic device with a foldable display, and the foldable display includes at least a first display and a second display. The method includes: The electronic device determines, based on a first average use value of a to-be-measured parameter of the first display in a first statistical period and a first correspondence, a first actual value of the to-be-measured parameter of the first display at the end of the first statistical period; determines, based on a second average use value of a to-be-measured parameter of the second display in the first statistical period and a second correspondence, a second actual value of the to-be-measured parameter of the second display at the end of the first statistical period; then determines a compensation target value based on the first actual value and the second actual value when the first actual value is less than the second actual value; and writes the compensation target value into a first register configured to control the to-be-measured parameter of the first display, and writes the compensation target value into a second register configured to control the to-be-measured parameter of the second display; or writes the compensation target value into a first register configured to control the to-be-measured parameter of the first display, and prolongs working duration of the second display, so that the actual value of the to-be-measured parameter of the second display is consistent with the actual value of the to-be-measured parameter of the first display.

Based on the solution, the electronic device may separately determine the actual values of the first display and the second display by using statistical data. Then, for the first display whose actual value of the to-be-measured parameter is relatively low, a maximum value of the to-be-measured parameter is increased by writing the compensation target value into the first register; and for the second display whose actual value of the to-be-measured parameter is relatively high, a maximum value of the to-be-measured parameter is decreased by writing the compensation target value into the second register, so that the maximum values of the to-be-measured parameters of the first display and the second display may be consistent. For the second display whose actual value of the to-be-measured parameter is relatively high, the maximum values of the first display and the second display may alternatively be made consistent by prolonging the working duration. In this way, a difference between the to-be-measured parameters of the first display and the second display may be reduced, so that display effects of different displays are consistent.

In a possible design, the determining, based on a first average use value of a to-be-measured parameter of the first display in a first statistical period and a first correspondence, a first actual value of the to-be-measured parameter of the first display at the end of the first statistical period may specifically include: The electronic device may obtain first use statistical data corresponding to the to-be-measured parameter of the first display in the first statistical period, and determine, based on the first use statistical data, the first average use value of the to-be-measured parameter of the first display in the first statistical period; and then determine the first actual value based on the first average use value and the first correspondence, where the first correspondence includes a correspondence between an average use value and an actual value of the to-be-measured parameter of the first display.

According to the design, the electronic device may periodically collect use statistical data of the to-be-measured parameter of the first display, and then may accurately determine, based on the first correspondence, an actual value of the to-be-measured parameter of the first display at the end of a statistical period.

In a possible design, the determining, based on a second average use value of a to-be-measured parameter of the second display in the first statistical period and a second correspondence, a second actual value of the to-be-measured parameter of the second display at the end of the first statistical period may specifically include: The electronic device may obtain second use statistical data corresponding to the to-be-measured parameter of the second display in the first statistical period, and determine, based on the second use statistical data, the second average use value of the to-be-measured parameter of the second display in the first statistical period; and then determine the second actual value based on the second average use value and the second correspondence, where the second correspondence includes a correspondence between an average use value and an actual value of the to-be-measured parameter of the second display.

According to the design, the electronic device may periodically collect use statistical data of the to-be-measured parameter of the second display, and then may accurately determine, based on the second correspondence, an actual value of the to-be-measured parameter of the second display at the end of a statistical period.

In a possible design, the to-be-measured parameter is luminance. The writing the compensation target value into a first register configured to control the to-be-measured parameter of the first display includes: determining a first current value corresponding to the compensation target value, and increasing a working current of the first display to the first current value; and triggering, by using the first current value, a driver IC of the first display to write the compensation target value into the first register. In this manner, the electronic device may adjust the working current of the first display with relatively low actual luminance, to increase the luminance of the first display, so that display effects of the first display and the second display are consistent.

In a possible design, the to-be-measured parameter is luminance. The writing the compensation target value into a second register configured to control the to-be-measured parameter of the second display includes: determining a second current value corresponding to the compensation target value, and decreasing a working current of the second display to the second current value; and triggering, by using the second current value, a driver IC of the second display to write the compensation target value into the second register. In this manner, the electronic device may adjust the working current of the second display with relatively high actual luminance, to decrease the luminance of the second display, so that display effects of the first display and the second display are consistent.

In a possible design, the to-be-measured parameter is luminance. The prolonging working duration of the second display, so that the actual value of the to-be-measured parameter of the second display is consistent with the actual value of the to-be-measured parameter of the first display includes: determining first working duration required for decreasing the second actual value to the compensation target value when luminance of the second display is set to preset luminance; and prolonging the working duration of the second display by the first working duration. In this manner, the electronic device may adjust the working duration of the second display with relatively high actual luminance, to decrease the luminance of the second display, so that display effects of the first display and the second display are consistent.

Further, the prolonging the working duration of the second display by the first working duration may specifically include: when the second display is in a screen-off state, turning on the second display, and controlling working duration of the second display in a screen-on state to be the first working duration. In this way, the luminance of the second display may be adjusted when a user does not use the second display, so that the user can use the second display without being affected.

Further, to adjust the luminance of the second display in a scenario in which the user does not perceive the adjustment, so that luminance display effects of the first display and the second display are consistent, the second display may be turned on in the following several cases:

In a first case, the electronic device may detect a device status of the electronic device, where the device status may include a static state or a motion state; and when the device status of the electronic device is the static state and the second display is in the screen-off state, turn on the second display, and control the working duration of the second display in the screen-on state to be the first working duration.

In this case, for example, a gyro sensor and a gravity sensor may be used to collect device status data of the electronic device, and then the device status of the electronic device is determined. When the device status is the static state, the user may not use the electronic device, for example, in a charging scenario, so that the luminance of the second display may be adjusted in a scenario in which the user does not perceive the adjustment.

In a second case, the electronic device may detect ambient luminance of the electronic device; and when detecting that ambient luminance of the second display is less than a preset threshold, turn on the second display, and control the working duration of the second display in the screen-on state to be the first working duration.

In this case, for example, an ambient light sensor may be used to detect the ambient luminance of the electronic device. For example, in a dark night scenario, or in a scenario in which the electronic device is placed in a bag or a pocket, or in a scenario in which the user places the electronic device on a desktop for charging, and the second display is in contact with the desktop, the user generally does not use the second display in these scenarios, so that the luminance of the second display may be adjusted in a scenario in which the user does not perceive the adjustment.

In a third case, the electronic device may collect statistics on use time data of the second display used by the user of the electronic device, and determine, based on the use time data, a time segment in which the user does not use the second display; and in the time segment in which the user does not use the second display, turn on the second display, and control the working duration of the second display in the screen-on state to be the first working duration.

In a fourth case, the electronic device may detect an orientation of the second display when the user holds the electronic device. For example, a gyro sensor and an acceleration sensor detect that the second display faces away from the first display. In this case, the second display may be turned on, and the working duration of the second display in the screen-on state may be controlled to be the first working duration.

In the foregoing several cases, there may be a plurality of implementations of turning on the second display. In a possible manner, the second display is turned on, and the luminance of the second display quickly reaches required luminance. In another possible manner, the second display may be turned on, and the luminance of the second display may be controlled to be gradually increased based on a preset luminance interval.

In a possible design, the first actual value is less than the second actual value, that is, the actual luminance of the first display is less than the actual luminance of the second display. A sum of a second compensation value and a target value is equal to a sum of the second actual value and a third compensation value. That is, for the second display, the luminance of the second display may be decreased to the target value by combining two adjustment manners. Specifically, the electronic device determines a first current value corresponding to a sum of the first actual value and a first compensation value, and determines a second current value corresponding to the sum of the second actual value and the third compensation value; determines second working duration required for decreasing the luminance of the second display from the sum of the second actual value and the third compensation value to the target value; and then increases the working current of the first display to the first current value, increases the working current of the second display to the second current value, and controls the working duration of the second display to be prolonged by the second working duration.

In this manner, the electronic device may perform current adjustment on the first display with relatively low actual luminance, to increase the luminance of the first display to the target value; and may perform adjustment on the second display with relatively high actual luminance by combining two different adjustment manners (working current adjustment and working duration adjustment), so that the luminance of the second display may be increased by increasing the working current, and the luminance of the second display may be decreased by prolonging the working duration. In this way, the luminance of the second display is decreased to the target value in a combination manner, so that luminance display effects of the first display and the second display are consistent.

In a possible design, the to-be-measured parameter is a gray scale. The writing the compensation target value into a first register configured to control the to-be-measured parameter of the first display, and writing the compensation target value into a second register configured to control the to-be-measured parameter of the second display includes: determining an R component, a G component, and a B component that are corresponding to a compensation target value of the gray scale; and separately writing the R component, the G component, and the B component that are corresponding to the compensation target value of the gray scale into the first register and the second register.

In this manner, RGB components corresponding to a first actual value of a gray scale of the first display and RGB components corresponding to an actual value of a gray scale of the second display may be separately compensated by adjusting the RGB components, so that gray scale display effects of the first display and the second display are consistent.

In a possible design, a display area of the first display is divided into N first areas, a display area of the second display is divided into N second areas, and N is a positive integer. The determining, based on a first average use value of a to-be-measured parameter of the first display in a first statistical period and a first correspondence, a first actual value of the to-be-measured parameter of the first display at the end of the first statistical period includes: determining, based on a first average use value of a to-be-measured parameter of each of the N first areas in the first statistical period and the first correspondence, a first actual value of the to-be-measured parameter of each first area at the end of the first statistical period. The determining, based on a second average use value of a to-be-measured parameter of the second display in the first statistical period and a second correspondence, a second actual value of the to-be-measured parameter of the second display at the end of the first statistical period includes: determining, based on a second average use value of a to-be-measured parameter of each of the N second areas in the first statistical period and the second correspondence, a second actual value of the to-be-measured parameter of each second area at the end of the first statistical period. The determining a compensation target value based on the first actual value and the second actual value when the first actual value is less than the second actual value includes: for each of the N first areas, determining a second area that has a positional correspondence with the first area, and determining the compensation target value based on a first actual value of the first area and a second actual value of the second area that has the positional correspondence with the first area. The writing the compensation target value into a first register configured to control the to-be-measured parameter of the first display, and writing the compensation target value into a second register configured to control the to-be-measured parameter of the second display includes: writing the compensation target value into a first register configured to control the to-be-measured parameter of the first area, and writing the compensation target value into a second register configured to control a to-be-measured parameter of the second area that has the positional correspondence with the first area. Alternatively, the writing the compensation target value into a first register configured to control the to-be-measured parameter of the first display, and prolonging working duration of the second display, so that the actual value of the to-be-measured parameter of the second display is consistent with the actual value of the to-be-measured parameter of the first display includes: writing the compensation target value into a first register configured to control the to-be-measured parameter of the first area, and prolonging working duration of the second area that has the positional correspondence with the first area, so that an actual value of a to-be-measured parameter of the second area that has the positional correspondence with the first area is consistent with the actual value of the to-be-measured parameter of the first area.

According to the design, the electronic device may separately perform area comparison at same positions on the first display and the second display, to more carefully compensate for a difference between the first display and the second display, so that display effects of to-be-measured parameters of the first display and the second display are consistent.

According to a second aspect, an embodiment of this application further provides an electronic device. The electronic device includes a display, one or more processors, a memory, and one or more programs, where the display includes at least a first display and a second display. The one or more programs are stored in the memory, the one or more programs include instructions, and when the instructions are executed by the electronic device, the electronic device is enabled to perform the technical solution according to any one of the first aspect and the possible designs of the first aspect.

According to a third aspect, an embodiment of this application further provides an electronic device. The electronic device includes modules/units that perform the method according to any one of the first aspect or the possible designs of the first aspect. These modules/units may be implemented by hardware, or may be implemented by hardware by executing corresponding software.

According to a fourth aspect, an embodiment of this application further provides a chip. The chip is coupled to a memory in an electronic device, and is configured to invoke a computer program stored in the memory and execute the technical solution according to any one of the first aspect and the possible designs of the first aspect in the embodiments of this application. In this embodiment of this application, "coupling" means that two components are directly or indirectly combined with each other.

According to a fifth aspect, an embodiment of this application further provides a computer-readable storage medium. The computer-readable storage medium stores computer-executable instructions, and the computer-executable instructions are used to enable the computer to perform the technical solution according to any one of the first aspect and the possible designs of the first aspect in embodiments of this application.

According to a sixth aspect, a program product in an embodiment of this application includes program instructions. When the program instructions run on an electronic device, the electronic device is enabled to perform the technical solution according to any one of the first aspect and the possible designs of the first aspect in embodiments of this application.

DESCRIPTION OF EMBODIMENTS

Figure 1A:
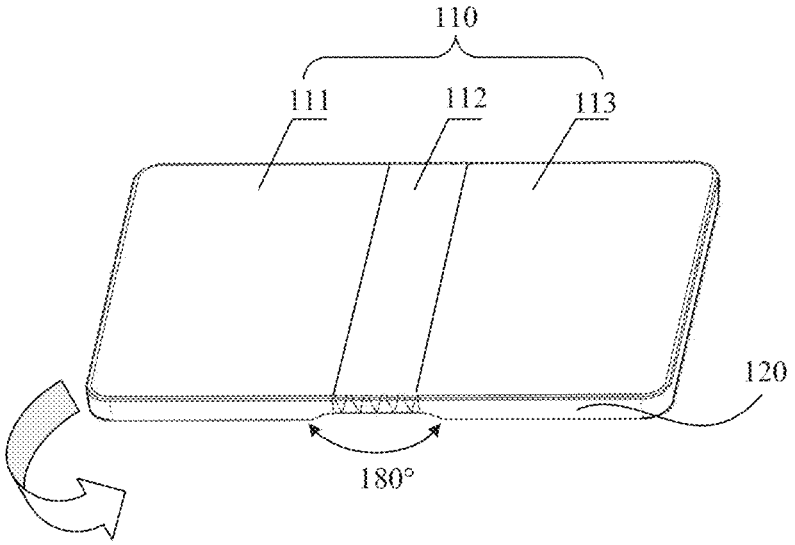
FIG. 1A is a schematic diagram of a scenario in which a mobile phone is fully unfolded according to an embodiment of this application.

The following clearly and describes the technical solutions in the embodiments of this application with reference to the accompanying drawings in the embodiments of this application. It is clear that the described embodiments are merely some but not all of the embodiments of this application. All other embodiments obtained by persons of ordinary skill in the art based on the embodiments of this application without creative efforts shall fall within the protection scope of this application.

The following describes some terms in the embodiments of this application to help persons skilled in the art have a better understanding.

The embodiments of this application relate to a mura (Mura) phenomenon, which is due to a limitation of a crystallization process. A low temperature poly-silicon thin-film transistor (low temperature poly-silicon thin-film transistor, LTPS TFT) manufactured on a large-area glass substrate is used as an example for description. TFTs at different positions usually have non-uniformity in electrical parameters such as a threshold voltage and mobility. The non-uniformity is transformed into a current difference and a luminance difference of OLED display components, which are perceived by human eyes, that is, the mura phenomenon. It should be understood that a color difference recognizable to human eyes may also be considered as a mura phenomenon.

Herein, a material of a display is not limited. That is, provided that there is a luminance difference, a color difference, or the like on the display due to non-uniformity in an electrical parameter, compensation may be performed by using a compensation method in the embodiments of this application, to reduce the difference.

An optical compensation (Demura) technology in the embodiments of this application is a technology in which a specific technical means is used to detect whether there is a mura phenomenon on a display, and after the mura phenomenon is detected, a difference in the mura phenomenon is compensated for, to eliminate the difference in the mura phenomenon. For example, an electronic device with a foldable display includes a primary display and a secondary display, and a luminance difference between the primary display and the secondary display is compensated for, to make luminance of the primary display and the secondary display consistent.

Specifically, when there is a luminance difference between the primary display and the secondary display, that is, when a maximum luminance value of the primary display is inconsistent with a maximum luminance value of the secondary display, even if a same luminance parameter is set for the primary display and the secondary display, a luminance setting value of the primary display is different from a luminance setting value of the secondary display. For example, the maximum luminance value of the primary display is 500 nits, and maximum luminance of the secondary display is 400 nits. A user sets luminance parameters of both the primary display and the secondary display to 50%. The luminance setting value of the primary display is 250 nits, and the setting value of the secondary display is 200 nits. Therefore, luminance display effects of the primary display and the secondary display are inconsistent.

In the embodiments of this application, a value may be written into a driver IC of the primary display (in the driver IC, the value corresponds to a target luminance value), and the driver IC may adjust maximum luminance of the display to the target luminance value. Similarly, another value (also corresponding to the target luminance value) may be written into a driver IC of the secondary display, and the driver IC may also adjust maximum luminance of the display to the target luminance value. In this way, the maximum luminance of the primary display is consistent with the maximum luminance value of the secondary display. Therefore, when a same luminance parameter is separately set for the primary display and the secondary display, display luminance of the primary display is the same as display luminance of the secondary display, that is, luminance display effects of the primary display and the secondary display are the same.

In the following, luminance of the primary display and the secondary display is compensated in various manners, and a result of the compensation is actually that maximum luminance of the primary display and the secondary display is adjusted to reduce a difference between maximum luminance values of the primary display and the secondary display, so that the maximum luminance values of the primary display and the secondary display are consistent. In the following, a principle of compensation for a gray scale difference (or an RGB value difference) between the primary display and the secondary display is the same, and details are not described below.

Figure 1B:
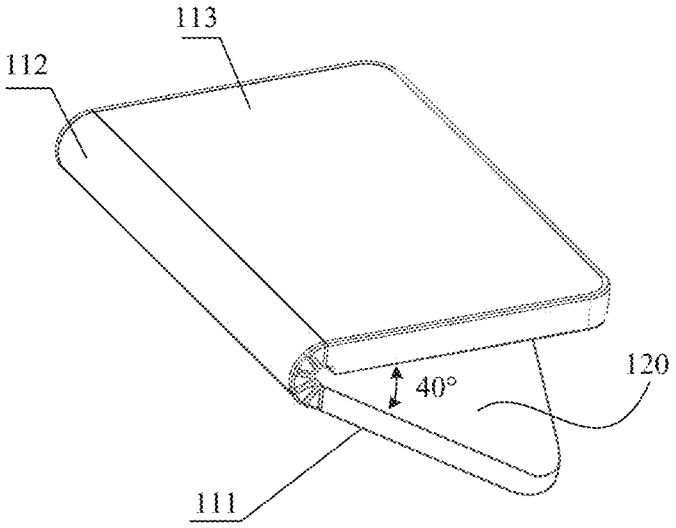
FIG. 1B is a schematic diagram of a scenario in which a mobile phone is partially folded according to an embodiment of this application.
Figure 1C:
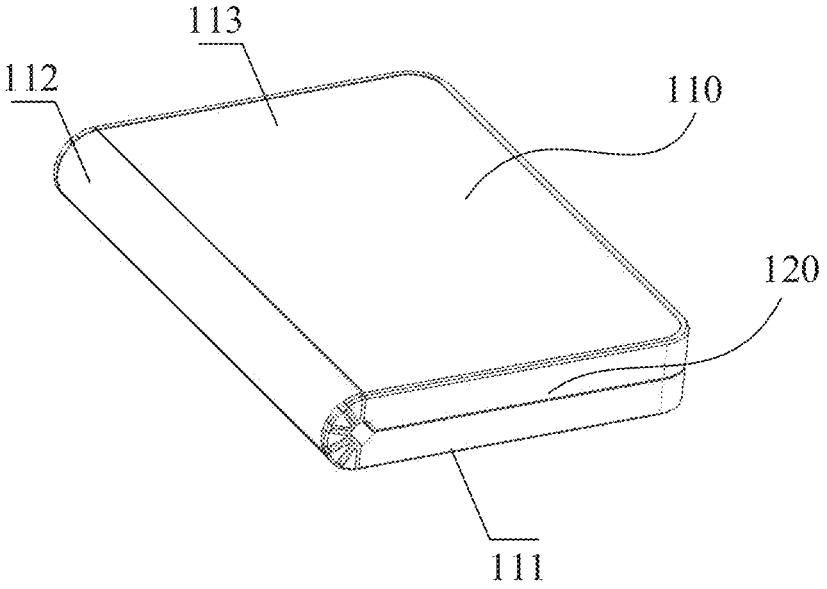
FIG. 1C is a schematic diagram of a scenario in which a mobile phone is fully folded according to an embodiment of this application.

In the embodiments of this application, the electronic device with the foldable display may be a mobile phone, a tablet computer (pad), a notebook computer, or the like. For example, the electronic device is a mobile phone. A foldable display of the mobile phone may be an integrated flexible display, or may be a display including at least two rigid displays and one flexible display located between the two rigid displays. For example, the foldable display provided in the embodiments of this application includes three parts. As shown in FIG. 1A, FIG. 1B, and FIG. 1C, the foldable display may include a first display 111, a second display 112, and a bendable area 112 that connects the first display 111 and the second display 113.

The following describes shapes of the foldable display of the mobile phone in different statuses with reference to the accompanying drawings.

FIG. 1A is a schematic diagram of a shape of the mobile phone when the mobile phone is fully unfolded. As shown in FIG. 1A, when the mobile phone is unfolded, a housing 120 of the mobile phone is unfolded, and the foldable display 110 is also unfolded. The foldable display 110 may include the first display 111, the bendable area 112, and the second display 113. When the foldable display 110 of the mobile phone is fully unfolded, the first display 111, the bendable area 112, and the second display 113 are connected to form an entire display. In this case, a gravity sensor may detect that an included angle a between the first display 111 and the second display 113 is 180° (subject to a reported actual folding angle, where the actual folding angle may not reach 180°.

In the embodiments of this application, when the first display 111 or the second display 113 is rotated, the foldable display 110 may be folded by using the bendable area 112. When the foldable display of the mobile phone is partially folded, refer to FIG. 1B. For a shape after the foldable display of the mobile phone is fully folded, refer to FIG. 1C.

As shown in FIG. 1B and FIG. 1C, when the mobile phone is folded, the housing 120 of the mobile phone is also folded, and the foldable display 110 is also folded. In examples shown in FIG. 1B and FIG. 1C, the foldable display 110 is located on an exposed side when the mobile phone is folded. It should be understood that, when the mobile phone is folded, the housing 120 may be exposed, and the foldable display 110 is located on an inner side; or the foldable display 110 may be an exposed part.

In a process of fully folding the foldable display 110 of the mobile phone that is fully unfolded, the included angle a between the first display 111 and the second display 113 becomes increasingly smaller. As shown in FIG. 1A, when the foldable display 110 is fully unfolded, the included angle between the first display 111 and the second display 113 is 180°. As shown in FIG. 1B, when the foldable display 110 of the mobile phone is partially folded, a gravity sensor 180E may detect that the included angle between the first display 111 and the second display 113 is 40°. As shown in FIG. 1C, when the foldable display 110 of the mobile phone is fully folded, the sensor detects that the included angle between the first display 111 and the second display 113 is 0° (subject to a reported actual folding angle, where the actual folding angle may not reach 0°). In this case, the first display 111 and the second display 113 are located on an exposed side when the mobile phone is folded.

When the mobile phone is folded, an example in which the second display 113 faces the user is used for description. The second display 113 that faces the user is referred to as a primary display, the first display 111 on the back is referred to as a secondary display, and the bendable area 112 may be referred to as a side display. When the mobile phone is folded, due to different use scenarios and a use habit of the user for the primary display and the secondary display, for example, the user is used to using the primary display when the mobile phone is folded, and the secondary display is in a screen-off state, after the mobile phone is used for a period of time, it is found that use duration of the primary display, the side display, and the secondary display is different. This causes a problem that aging degrees of the primary display, the side display, and the secondary display are inconsistent. Luminance is used as an example. For example, luminance of the primary display is less than luminance of the secondary display, and the luminance of the secondary display is less than luminance of the bendable area. When the mobile phone is fully unfolded, the primary display, the side display, and the secondary display form one display, and the user faces the entire display. When the entire display is displayed, the user may find a problem such as inconsistent display luminance or inconsistent colors in different areas of the entire display.

Therefore, this application provides a compensation method. When there is a difference between aging degrees of a plurality of displays (for example, a primary display, a side display, and a secondary display) included in an electronic device, the compensation method is used to compensate the displays. For example, when there is a luminance difference between the primary display, the secondary display, and the side display, luminance of the displays may be compensated, so that the luminance of the displays is consistent. For another example, when there is a color difference between the displays, RGB values of the displays may be adjusted, so that colors of the displays are consistent. In this way, display effects of an entire display are consistent.

It should be noted that, currently, for a mobile phone with a foldable display, a side display may be adjusted together with a primary display, or the side display may be adjusted together with a secondary display. This is related to a display with which a rotating shaft of the foldable display is rotated together. For example, when the mobile phone is folded, the rotating shaft is rotated together with the secondary display. Working circuits of the secondary display and the side display may be controlled together. That is, for example, when luminance of the secondary display is decreased by controlling a working circuit of the secondary display, luminance of the side display is also decreased. That is, the luminance of the secondary display and the side display is adjusted together.

"A plurality of" in the embodiments of this application means being greater than or equal to two.

It should be noted that the term "and/or" in this specification describes only an association for describing associated objects and represents that three relationships may exist. For example, A and/or B may represent the following three cases: Only A exists, both A and B exist, and only B exists. In addition, unless otherwise specified, the character "/" in this specification generally indicates an "or" relationship between the associated objects. Moreover, in the descriptions of the embodiments of this application, terms such as "first" and "second" are merely used for distinction and description, but cannot be understood as indication or implication of relative importance, and cannot be understood as an indication or implication of a sequence.

The following describes an electronic device and an embodiment for using such an electronic device. In some embodiments of this application, the electronic device may be a portable terminal including a display, for example, a mobile phone or a tablet computer. An example embodiment of a portable electronic device includes but is not limited to a portable electronic device using iOS®, Android®, Microsoft®, or another operating system. The portable electronic device may alternatively be another portable electronic device, such as a digital camera. It should further be understood that, in some other embodiments of this application, the electronic device may alternatively not be a portable electronic device, but a desktop computer or the like with a display.

Figure 2:
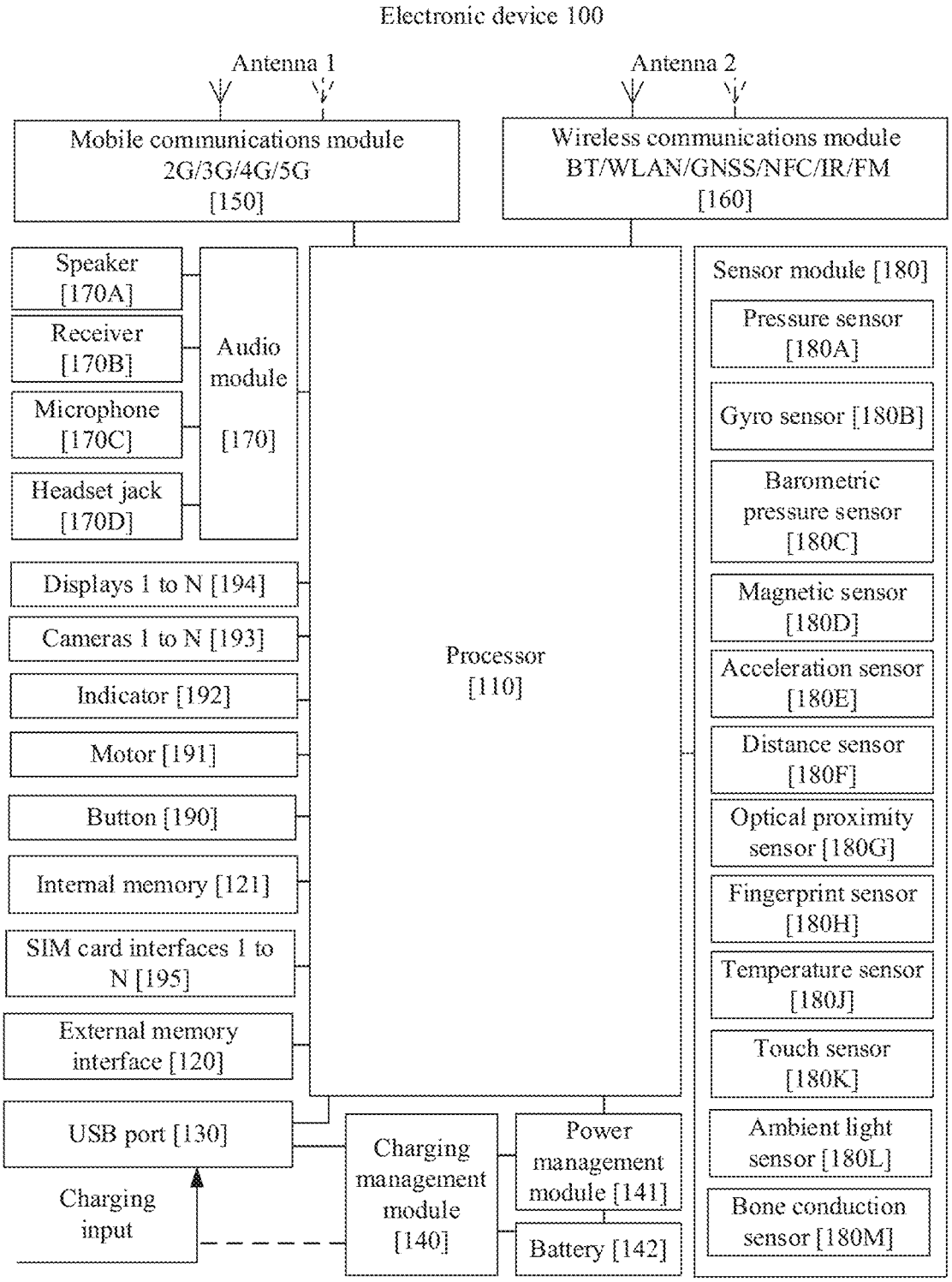
FIG. 2 is a schematic diagram of a structure of a mobile phone according to an embodiment of this application.

The following uses an example in which the electronic device is a mobile phone. FIG. 2 is a schematic diagram of a structure of a mobile phone 100.

The mobile phone 100 may include a processor 110, an external memory interface 120, an internal memory 121, a universal serial bus (universal serial bus, USB) port 130, a charging management module 140, a power management module 141, a battery 142, an antenna 1, an antenna 2, a mobile communications module 150, a wireless communications module 160, an audio module 170, a speaker 170A, a receiver 170B, a microphone 170C, a headset jack 170D, a sensor module 180, a button 190, a motor 191, an indicator 192, a camera 193, a display 194, a subscriber identification module (subscriber identification module, SIM) card interface 195, and the like. The sensor module 180 may include a pressure sensor 180A, a gyro sensor 180B, a barometric pressure sensor 180C, a magnetic sensor 180D, an acceleration sensor 180E, a distance sensor 180F, an optical proximity sensor 180G, a fingerprint sensor 180H, a temperature sensor 180J, a touch sensor 180K, an ambient light sensor 180L, a bone conduction sensor 180M, and the like.

The processor 110 may include one or more processing units. For example, the processor 110 may include an application processor (application processor, AP), a modem processor, a graphics processing unit (graphics processing unit, GPU), an image signal processor (image signal processor, ISP), a controller, a memory, a video codec, a digital signal processor (digital signal processor, DSP), a baseband processor, a neural-network processing unit (neural-network processing unit, NPU), and/or the like. Different processing units may be independent components, or may be integrated into one or more processors.

The controller may be a nerve center and a command center of the mobile phone 100. The controller may generate an operation control signal based on an instruction operation code and a time sequence signal, to complete control of instruction fetching and instruction execution.

A memory may further be disposed in the processor 110, and is configured to store instructions and data. In some embodiments, the memory in the processor 110 is a cache. The memory may store instructions or data just used or cyclically used by the processor 110. If the processor 110 needs to use the instructions or the data again, the processor 110 may directly invoke the instructions or the data from the memory. This avoids repeated access and reduces a waiting time of the processor 110, thereby improving system efficiency.

The processor 110 may run software code of the compensation method provided in the embodiments of this application, to implement a process of compensating a to-be-measured parameter of each display of the electronic device, where the to-be-measured parameter may be luminance, a gray scale, or an RGB value.

The USB port 130 is a port that conforms to a USB standard specification, and may be specifically a mini USB port, a micro USB port, a USB Type-C port, or the like. The USB port 130 may be configured to connect to a charger to charge the mobile phone 100, and may also be configured to transmit data between the mobile phone 100 and a peripheral device.

The charging management module 140 is configured to receive a charging input from a charger. The power management module 141 is configured to connect the battery 142 and the charging management module 140 to the processor 110. The power management module 141 receives an input of the battery 142 and/or the charging management module 140, to supply power to the processor 110, the internal memory 121, an external memory, the display 194, the camera 193, the wireless communications module 160, and the like.

A wireless communication function of the mobile phone 100 may be implemented through the antenna 1, the antenna 2, the mobile communications module 150, the wireless communications module 160, the modem processor, the baseband processor, and the like.

The antenna 1 and the antenna 2 are configured to transmit and receive electromagnetic wave signals. Each antenna in the mobile phone 100 may be configured to cover one or more communication frequency bands. Different antennas may further be multiplexed, to improve antenna utilization. For example, the antenna 1 may be multiplexed as a diversity antenna in a wireless local area network. In some other embodiments, the antenna may be used in combination with a tuning switch.

The mobile communications module 150 may provide a solution that is applied to the mobile phone 100 and that includes wireless communication such as 2G, 3G, 4G and 5G. The mobile communications module 150 may include at least one filter, a switch, a power amplifier, a low noise amplifier (low noise amplifier, LNA), and the like. The mobile communications module 150 may receive an electromagnetic wave through the antenna 1, perform processing such as filtering and amplification on the received electromagnetic wave, and transmit a processed electromagnetic wave to the modem processor for demodulation. The mobile communications module 150 may further amplify a signal modulated by the modem processor, and convert the signal into an electromagnetic wave for radiation through the antenna 1. In some embodiments, at least some function modules of the mobile communications module 150 may be disposed in the processor 110. In some embodiments, at least some function modules of the mobile communications module 150 may be disposed in a same component as at least some modules of the processor 110.

The wireless communications module 160 may provide a solution that is applied to the mobile phone 100 and that includes wireless communication such as a wireless local area network (wireless local area network, WLAN) (for example, a wireless fidelity (wireless fidelity, Wi-Fi) network), Bluetooth (Bluetooth, BT), a global navigation satellite system (global navigation satellite system, GNSS), frequency modulation (frequency modulation, FM), a near field communication (near field communication, NFC) technology, and an infrared (infrared, IR) technology. The wireless communications module 160 may be one or more components integrating at least one communications processor module. The wireless communications module 160 receives an electromagnetic wave through the antenna 2, performs frequency modulation and filtering processing on an electromagnetic wave signal, and sends a processed signal to the processor 110. The wireless communications module 160 may further receive a to-be-sent signal from the processor 110, perform frequency modulation and amplification on the signal, and convert a processed signal into an electromagnetic wave for radiation through the antenna 2.

In some embodiments, the antenna 1 of the mobile phone 100 is coupled to the mobile communications module 150, and the antenna 2 is coupled to the wireless communications module 160, so that the mobile phone 100 can communicate with a network and another device by using a wireless communications technology. The wireless communications technology may include a global system for mobile communications (global system for mobile communications, GSM), a general packet radio service (general packet radio service, GPRS), code division multiple access (code division multiple access, CDMA), wideband code division multiple access (wideband code division multiple access, WCDMA), time-division code division multiple access (time-division code division multiple access, TD-SCDMA), long term evolution (long term evolution, LTE), BT, a GNSS, a WLAN, NFC, FM, an IR technology, and/or the like. The GNSS may include a global positioning system (global positioning system, GPS), a global navigation satellite system (global navigation satellite system, GLONASS), a BeiDou navigation satellite system (BeiDou navigation satellite system, BDS), a quasi-zenith satellite system (quasi-zenith satellite system, QZSS), and/or a satellite based augmentation system (satellite based augmentation system, SBAS).

The mobile phone 100 implements a display function by using the GPU, the display 194, the application processor, and the like. The GPU is a microprocessor for image processing, and is connected to the display 194 and the application processor. The GPU is configured to perform mathematical and geometric calculation, and render an image. The processor 110 may include one or more GPUs that execute program instructions to generate or change display information.

The display 194 is configured to display an image, a video, and the like. The display 194 includes a display panel. The display panel may be a liquid crystal display (liquid crystal display, LCD), an organic light-emitting diode (organic light-emitting diode, OLED), an active-matrix organic light-emitting diode (active-matrix organic light emitting diode, AMOLED), a flexible light-emitting diode (flex light-emitting diode, FLED), a mini-LED, a micro-LED, a micro-OLED, quantum dot light emitting diodes (quantum dot light emitting diodes, QLEDs), or the like. In some embodiments, the mobile phone 100 may include one or N displays 194, where N is a positive integer greater than 1.

The camera 193 is configured to capture a static image or a video. The camera 193 may include a front-facing camera and a rear-facing camera.

The internal memory 121 may be configured to store computer-executable program code. The executable program code includes instructions. The processor 110 runs the instructions stored in the internal memory 121, to perform various function applications of the mobile phone 100 and data processing. The internal memory 121 may include a program storage area and a data storage area. The program storage area may store an operating system, software code of at least one application, and the like. The data storage area may store data (for example, an image or a video) generated in a process of using the mobile phone 100, and the like. In addition, the internal memory 121 may include a high-speed random access memory, and may further include a non-volatile memory, for example, at least one magnetic disk storage component, a flash component, or a universal flash storage (universal flash storage, UFS).

The internal memory 121 may further store software code of the compensation method provided in the embodiments of this application. When the processor 110 runs the software code, procedure steps of the compensation method are performed, to implement a process of compensating a target parameter of each display of the electronic device.

The internal memory 121 may further store use statistical data corresponding to a to-be-measured parameter of each display, a compensation value obtained through calculation, an aging model, various correspondences, and the like.

The external memory interface 120 may be configured to connect to an external storage card, for example, a micro SD card, to extend a storage capability of the mobile phone 100. The external memory card communicates with the processor 110 through the external memory interface 120, to implement a data storage function.

Certainly, the software code of the compensation method provided in the embodiments of this application may alternatively be stored in an external memory. The processor 110 may run the software code through the external memory interface 120, to perform the procedure steps of the compensation method, thereby implementing the process of compensating the target parameter of each display of the electronic device. The use statistical data corresponding to the to-be-measured parameter of each display, the compensation value obtained through calculation, the aging model, the various correspondences, and the like that are obtained by the mobile phone 100 may also be stored in the external memory.

The mobile phone 100 may implement an audio function, for example, music playing or recording, by using the audio module 170, the speaker 170A, the receiver 170B, the microphone 170C, the headset jack 170D, the application processor, and the like.

The pressure sensor 180A is configured to sense a pressure signal, and can convert the pressure signal into an electrical signal. In some embodiments, the pressure sensor 180A may be disposed on the display 194.

The gyro sensor 180B may be configured to determine a motion posture of the mobile phone 100. In some embodiments, angular velocities of the mobile phone 100 around three axes (namely, axes x, y, and z) may be determined by using the gyro sensor 180B. The gyro sensor 180B may be configured to perform image stabilization during shooting.

The barometric pressure sensor 180C is configured to measure barometric pressure. In some embodiments, the mobile phone 100 calculates an altitude by using a value of the atmospheric pressure measured by the barometric pressure sensor 180C, to assist in positioning and navigation.

The magnetic sensor 180D includes a Hall sensor. The mobile phone 100 may detect opening and closing of a flip cover by using the magnetic sensor 180D. In some embodiments, when the mobile phone 100 is a flip phone, the mobile phone 100 may detect opening/closing of a flip cover based on the magnetic sensor 180D. Further, a feature such as automatic unlocking upon opening of the flip cover is set based on a detected opening or closing state of the flip cover.

The acceleration sensor 180E may detect magnitude of accelerations in various directions (generally on three axes) of the mobile phone 100. When the mobile phone 100 is still, magnitude and a direction of gravity may be detected. The acceleration sensor 180E may further be configured to identify a posture of the electronic device, and is used in screen switching between a landscape mode and a portrait mode, a pedometer, or another application.

The distance sensor 180F is configured to measure a distance. The mobile phone 100 may measure a distance in an infrared or laser manner. In some embodiments, in a shooting scenario, the mobile phone 100 may measure a distance by using the distance sensor 180F, to implement quick focusing.

The optical proximity sensor 180G may include, for example, a light-emitting diode (LED) and an optical detector, for example, a photodiode. The light-emitting diode may be an infrared light-emitting diode. The mobile phone 100 emits infrared light by using the light-emitting diode. The mobile phone 100 detects infrared reflected light from a nearby object by using the photodiode. When sufficient reflected light is detected, it can be determined that there is an object near the mobile phone 100. When insufficient reflected light is detected, the mobile phone 100 can determine that there is no object near the mobile phone 100. The mobile phone 100 may detect, by using the optical proximity sensor 180G, that a user holds the mobile phone 100 close to an ear for a call, to automatically turn off a screen to save power. The optical proximity sensor 180G may also be used in a leather case mode or a pocket mode to automatically unlock or lock the screen.

The ambient light sensor 180L is configured to sense ambient light brightness. The mobile phone 100 may adjust brightness of the display 194 based on the sensed ambient light brightness. The ambient light sensor 180L may also be configured to automatically adjust white balance during photographing. The ambient light sensor 180L may further cooperate with the optical proximity sensor 180G, to detect whether the mobile phone 100 is in a pocket, to prevent an accidental touch.

The fingerprint sensor 180H is configured to collect a fingerprint. The mobile phone 100 may use a feature of the collected fingerprint to implement fingerprint-based unlocking, application lock access, fingerprint-based photographing, fingerprint-based call answering, and the like.

The temperature sensor 180J is configured to detect a temperature. In some embodiments, the mobile phone 100 executes a temperature processing policy by using the temperature detected by the temperature sensor 180J. For example, when the temperature reported by the temperature sensor 180J exceeds a threshold, the mobile phone 100 lowers performance of a processor near the temperature sensor 180J, to reduce power consumption for thermal protection. In some other embodiments, when the temperature is lower than another threshold, the mobile phone 100 heats the battery 142, to avoid abnormal shutdown of the mobile phone 100 caused by a low temperature. In some other embodiments, when the temperature is lower than still another threshold, the mobile phone 100 boosts an output voltage of the battery 142, to avoid abnormal shutdown caused by a low temperature.

The touch sensor 180K is also referred to as a "touch panel". The touch sensor 180K may be disposed on the display 194, and the touch sensor 180K and the display 194 constitute a touchscreen, which is also referred to as a "touch screen". The touch sensor 180K is configured to detect a touch operation performed on or near the touch sensor 180K. The touch sensor may transfer the detected touch operation to the application processor, to determine a type of a touch event. A visual output related to the touch operation may be provided through the display 194. In some other embodiments, the touch sensor 180K may alternatively be disposed on a surface of the mobile phone 100 at a location different from that of the display 194.

The bone conduction sensor 180M may obtain a vibration signal. In some embodiments, the bone conduction sensor 180M may obtain a vibration signal of a vibration bone of a human vocal-cord part. The bone conduction sensor 180M may also be in contact with a human pulse, to receive a blood pressure beating signal.

The button 190 includes a power button, a volume button, and the like. The button 190 may be a mechanical button or a touch button. The mobile phone 100 may receive a button input, and generate a button signal input related to a user setting and function control of the mobile phone 100.

The motor 191 may generate a vibration prompt. The motor 191 may be configured to provide an incoming call vibration prompt and a touch vibration feedback.

The indicator 192 may be an indicator light, and may be configured to indicate a charging status and a power change, or may be configured to indicate a message, a missed call, a notification, and the like.

The SIM card interface 195 is configured to connect to a SIM card. The SIM card may be inserted into the SIM card interface 195 or removed from the SIM card interface 195, to implement contact with or separation from the mobile phone 100.

It may be understood that the structure shown in this embodiment of this application constitutes no specific limitation on the mobile phone 100. In some other embodiments of this application, the mobile phone 100 may include more or fewer components than those shown in the figure, or some components may be combined, or some components may be split, or there may be a different component layout. The components shown in the figure may be implemented by hardware, software, or a combination of software and hardware.

The following embodiments may be all implemented by the mobile phone 100 having the foregoing structure.

Figure 3:
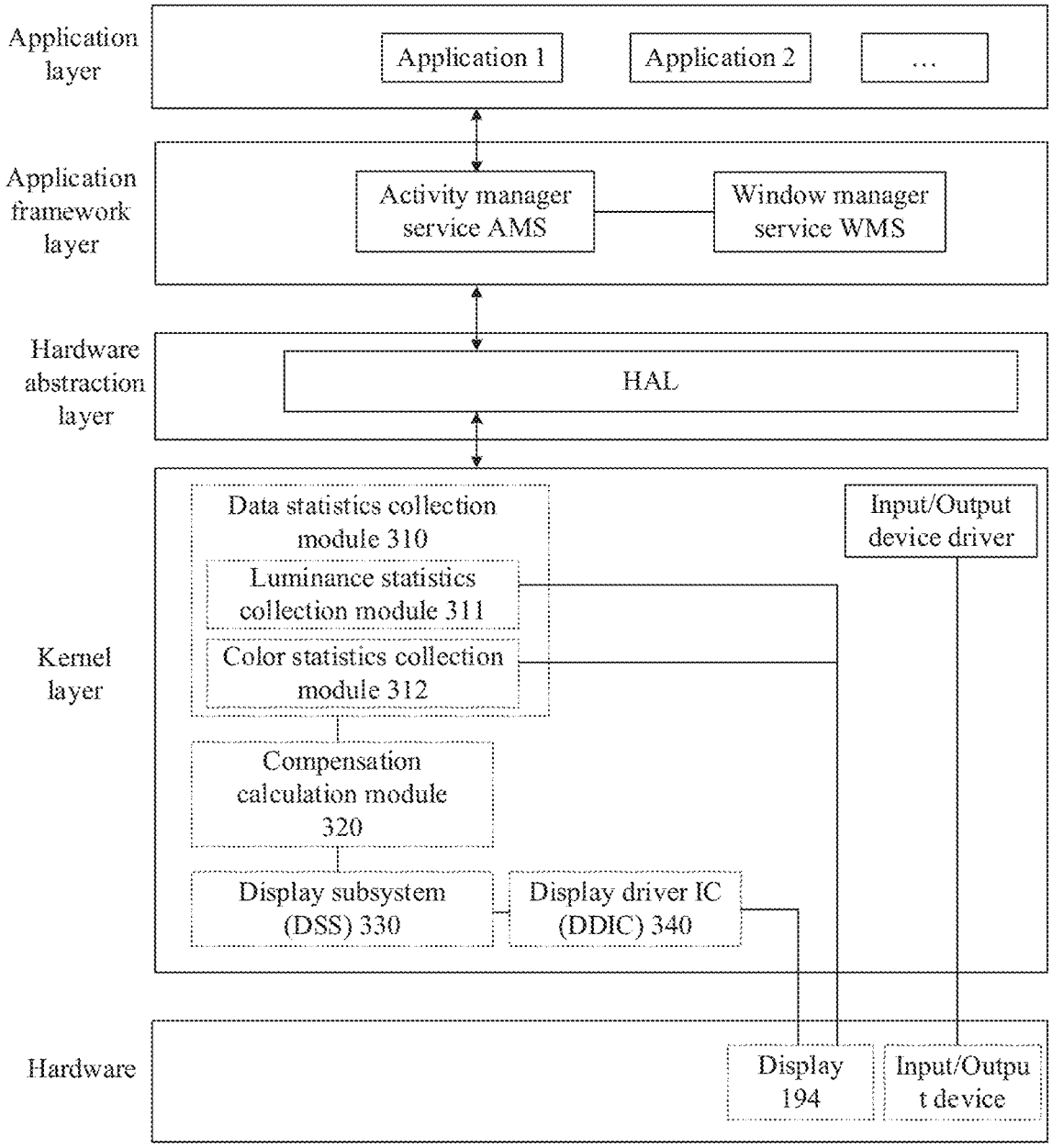
FIG. 3 is a schematic diagram of a software structure of a mobile phone 100 according to an embodiment of this application.

An embodiment of this application further provides a software architecture. As shown in FIG. 3, in a software architecture of a mobile phone 100, software may be divided into a plurality of layers, and each layer has a clear role and task. The layers communicate with each other through a software interface. In some embodiments, the software architecture may be divided into four layers: an application layer, an application framework layer framework layer for short), a hardware abstraction layer (hardware abstraction layer, HAL), and a kernel layer (also referred to as a driver layer) from top to bottom.

The application layer may include a series of application packages. As shown in FIG. 3, the application layer may include a plurality of application packages such as an application 1 and an application 2. For example, the application packages may include but are not limited to applications such as Camera, Gallery, Calendar, Phone, Map, Navigation, WLAN, Bluetooth, Music, Video, SMS message, and Desktop Launcher (Launcher).

The framework layer provides an application programming interface (application programming interface, API) and a programming framework for an application at the application layer. The application framework layer includes some predefined functions. As shown in FIG. 2, the framework layer may include a window manager service (window manager service, WMS), an activity manager service (activity manager service, AMS), and the like, where the window manager service WMS is used to manage a window program. The activity manager service AMS is responsible for work such as managing activities, starting, switching, and scheduling components in the system, and managing and scheduling applications. Optionally, the framework layer may further include a content provider, a view system, a phone manager, a resource manager, a notification manager, and the like (not shown in the accompanying drawing).

The hardware abstraction layer is used to provide the framework layer with a general-purpose interface for invoking a driver at the kernel layer, and distribute an input event sent by the kernel layer to an upper layer, namely, the application framework layer.

The kernel layer is a layer between hardware and software. The kernel layer may include a display driver, a camera driver, an audio driver, a sensor driver, drivers of input/output devices (for example, a keyboard, a touchscreen, a headset, a speaker, and a microphone), and the like.

In addition, the kernel layer may further include a data statistics collection module 310, a compensation calculation module 320, a display subsystem (display subsystem, DSS) 330, a driver (display driver IC, DDIC) 340 configured to drive a display chip, and the like. Functions of the modules are described as follows:

The data statistics collection module 310 is configured to: in a current statistical period, collect use statistical data corresponding to a to-be-measured parameter of each display of the mobile phone, and send the use statistical data to the compensation calculation module 320. The data statistics collection module 310 may include a luminance statistics collection module 311 and a color statistics collection module 312. The luminance statistics collection module 311 is configured to collect statistics on use duration corresponding to each luminance level of each display in a period of time. The color statistics collection module 312 is configured to collect statistics on use duration corresponding to each color value or each gray scale level of each display in a period of time.

After receiving the use statistical data sent by the data statistics collection module 310, the compensation calculation module 320 calculates compensation information between displays, and sends the compensation information and a value of a to-be-measured parameter of each display calculated at the end of a previous statistical period to the display subsystem (display subsystem, DSS) 330.

The display subsystem (DSS) 330 receives the compensation information and the value of the to-be-measured parameter of each display calculated at the end of the previous statistical period, determines a compensation value for compensating each display and an adjustment manner of the to-be-measured parameter, and delivers the compensation value and the adjustment manner of the to-be-measured parameter to the driver 340 configured to drive a display chip.

The driver 340 configured to drive a display chip compensates the to-be-measured parameter of each display based on the compensation value corresponding to each display and the adjustment manner of the to-be-measured parameter.

For ease of understanding, the following describes, with reference to FIG. 3, a specific example in which the to-be-measured parameter is luminance.

An example in which a luminance difference between a primary display and a secondary display that are included in the mobile phone 100 is compensated for is used for description. For example, the luminance is represented by levels, a maximum luminance level is 500 nits (nit), and a difference between every two luminance levels is 1 nit. The luminance statistics collection module 311 uses 10 minutes as a statistical period to record corresponding use duration of the primary display at each luminance level in real time, and record corresponding use duration of the secondary display at each luminance level. For example, the luminance statistics collection module 311 may collect statistics on the primary display in 10 minutes: Use duration corresponding to the luminance level 500 nits is 2 s, . . . , use duration corresponding to a luminance level 450 nits is 5 s, use duration corresponding to a luminance level 449 nits is 12 s, use duration corresponding to a luminance level 448 nits is 3 s, . . . , use duration corresponding to a luminance level 57 nits is 38 s, use duration corresponding to a luminance level 56 nits is 38 s, . . . , use duration corresponding to a luminance level 1 nit is 0 s, and use duration corresponding to a luminance level 0 nits is 360 s. For example, in a statistical period of 10 minutes, corresponding use duration of the secondary display at the luminance level 0 nits is 10 minutes, that is, the secondary display is not used in the statistical period.

The luminance statistics collection module 311 sends, to the compensation calculation module 320, the corresponding use duration of the primary display at each luminance level and the corresponding use duration of the secondary display at each luminance level, which are collected in 10 minutes.

On one hand, after receiving the corresponding use duration of the primary display at each luminance level, the compensation calculation module 320 may calculate an average luminance use value of the primary display. Refer to the following formula (1):

$$\overline{L}_{primary} = \frac{L_1T_1 + L_2T_2 + \ldots + L_{n-1}T_{n-1} + L_nT_n}{T_1 + T_2 + \ldots + T_{n-1} + T_n} \ldots \quad \text{Formula (1)}$$

In formula (1), $\overline{L}_{primary}$ is the average luminance use value of the primary display in 10 minutes; $L_1$, $L_2$, . . . , $L_{n-1}$, and $L_n$ are respectively various luminance levels; and $T_1$, $T_2$, $T_{n-1}$, and $T_n$ are respectively use duration of the primary display at various luminance levels, for example, $T_n$ is use duration of the primary display at a luminance level $L_n$.

Then, based on $\overline{L}_{primary}$ calculated based on formula (1) and a first correspondence, the compensation calculation module 320 may determine, from the first correspondence, a first actual value of luminance of the primary display at the end of a current statistical period, that is, an actual value corresponding to $\overline{L}_{primary}$. The first correspondence includes a correspondence between an average use value and an actual value of the luminance of the primary display.

It should be noted that the first correspondence may be preconfigured in the mobile phone 100 before the mobile phone is delivered from a factory, or may be determined based on historical use data in a use process of the mobile phone.

By using an example in which the first correspondence is configured in the mobile phone 100 before the mobile phone is delivered from a factory, the following describes a process of determining the first correspondence.

First, the luminance statistics collection module 311 collects statistics on luminance usage of a plurality of displays belonging to a same batch as a display 194 of the mobile phone 100 at a same ambient temperature, to obtain historical statistical data. The displays of the same batch use a same material and a same manufacturing process. The historical statistical data is shown in the following examples a1 and a2:

Example a1: At an ambient temperature of 25° C., a luminance loss value $\Delta L_1$ that is of a display A with initial luminance of 500 nits and that corresponds to use of 24 hours with working luminance set to 200 nits is measured.

In other words, an average luminance use value $\bar{L}$ of the display A in 24 hours is 200 nit/s. Assuming that $\Delta L_1$ is 10 nits, an actual luminance value of the display A at the end of 24 hours is a difference between the initial luminance and the luminance loss value, that is, 490 nits.

Example a2: At an ambient temperature of 25° C., a luminance loss value $\Delta L_2$ that is of a display B with initial luminance of 500 nits and that corresponds to use of 24 hours with working luminance set to 300 nits is measured. In other words, an average luminance use value $\bar{L}$ of the display B in 24 hours is 300 nit/s. Assuming that $\Delta L_2$ is 20 nits, an actual luminance value of the display B at the end of 24 hours is 480 nits.

The foregoing examples a1 and a2 are merely two examples. During actual statistics collection, more collected statistics on luminance usage of displays leads to a more accurate first correspondence.

Then, based on the initial luminance 500 nits of the display A in example a1, the actual luminance value 490 nits of the display A at the end of 24 hours, the initial luminance 500 nits of the display B in example a2, the actual luminance value 480 nits of the display B at the end of 24 hours, and the following aging formula (2), the compensation calculation module 320 may determine $\tau$ and $\beta$ in formula (2).

$$L=L_0e^{-(t/\tau)\beta} \quad \text{Formula (2)}$$

In formula (2), t is working duration, $L_0$ is initial luminance of the display, $\tau$ is a coefficient related to the initial luminance of the display, $\beta$ is a coefficient related to factors such as a material, a manufacturing process, and an ambient temperature of the display, and L is an actual luminance value of the display when the display is used for the working duration t.

It is assumed that the display A and the display B are consistent in the factors such as the material, the manufacturing process, and the ambient temperature. In this case, $\beta$ is a fixed value. Therefore, a plurality of correspondences between $\bar{L}$ and $\tau$ may be obtained based on formula (2) and a plurality of groups of L, $L_0$, t, and $\bar{L}$ that are obtained through statistics collection.

Further, when the compensation calculation module 320 calculates the average luminance use value $\bar{L}_{primary}$ of the primary display in the current statistical period, $\tau$ corresponding to $\bar{L}_{primary}$ may be determined based on a correspondence between $\bar{L}$ and $\tau$. Then, $\tau$ corresponding to $\bar{L}_{primary}$ is substituted into formula (2), to obtain an actual luminance value of the primary display at the end of the current statistical period. In this way, a correspondence between the average luminance use value and the actual luminance value of the primary display, that is, the first correspondence, may be obtained.

On the other hand, after receiving the corresponding use duration of the secondary display at each luminance level, the compensation calculation module 320 may further calculate an average luminance use value of the secondary display. Refer to the following formula (3):

$$\bar{L}_{secondary} = \frac{L_1T_1' + L_2T_2' + \ldots + L_{n-1}T_{n-1}' + L_nT_n'}{T_1' + T_2' + \ldots + T_{n-1}' + T_n'} \ldots \quad \text{Formula (3)}$$

In formula (3), $\bar{L}_{secondary}$ is the average luminance use value of the secondary display in 10 minutes; $L_1$, $L_2$, . . . , $L_{n-1}$, and $L_n$ are respectively various luminance levels; and $T_1'$, $T_2'$, . . . $T_{n-1}'$, and $T_n'$ are respectively use duration of the secondary display at various luminance levels, for example, $T_n'$ is use duration of the secondary display at a luminance level $L_n$.

Then, based on $\bar{L}_{secondary}$ calculated based on formula (3) and a second correspondence, the compensation calculation module 320 may determine a second actual value of luminance of the secondary display at the end of the current statistical period. The second correspondence includes a correspondence between an average use value and an actual value of the luminance of the secondary display. It should be noted that the second correspondence may be preconfigured in the mobile phone 100 before the mobile phone is delivered from a factory, or may be determined based on historical use data in a use process of the mobile phone.

In this embodiment of this application, for a manner of determining the second correspondence, refer to the manner of determining the first correspondence. Details are not described herein.

In the foregoing example, the manner of determining the first correspondence is described by using an example in which the to-be-measured parameter is luminance. For the first correspondence when the to-be-measured parameter is gray scale information or an RGB value, refer to the foregoing luminance example.

After determining the first actual value of the luminance of the primary display at the end of the current statistical period and the second actual value of the luminance of the secondary display at the end of the current statistical period, the compensation calculation module 320 may determine, based on the first actual value and the second actual value, compensation information corresponding to the luminance.

In this embodiment of this application, there are a plurality of manners of determining luminance compensation information between the primary display and the secondary display based on the first actual value and the second actual value, including but not limited to the following two manners:

Manner b1: A difference between the first actual value and the second actual value may be used as the luminance compensation information between the primary display and the secondary display.

In an example, initial luminance of the primary display and the secondary display is 500 nits, the first actual value of the luminance of the primary display is 400 nits, and the second actual value of the luminance of the secondary display is 450 nits. It may be learned that a luminance loss value of the primary display is greater than a luminance loss value of the secondary display. That is, it may be determined that an aging degree of the primary display is greater than an aging degree of the secondary display, and it may be determined that a luminance difference between the primary display and the secondary display is 50 nits, which is the luminance compensation information between the primary display and the secondary display.

Manner b2: A compensation coefficient may be determined based on the first actual value, the second actual value, and a first initial value of a to-be-measured parameter of the primary display, and used as the luminance compensation information between the primary display and the secondary display.

The compensation coefficient a may be determined based on the following formula (4):

$$a = \frac{L_{primary} - L_{secondary}}{L_{initial}} \ldots \quad \text{Formula (4)}$$

In formula (4), $L_{initial}$ is the initial luminance of the primary display and the secondary display, $L_{primary}$ is the first actual value of the luminance of the primary display at the end of the current statistical period, and $L_{secondary}$ is the second actual value of the luminance of the secondary display at the end of the current statistical period.

For example, the initial luminance of the primary display and the secondary display is 500 nits, the first actual value of the luminance of the primary display is 400 nits, and the second actual value of the luminance of the secondary display is 450 nits. By using formula (4), it may be determined that the compensation coefficient is 1%, which is the luminance compensation information between the primary display and the secondary display.

After the compensation calculation module 320 determines the luminance compensation information between the primary display and the secondary display, the display subsystem (DSS) 330 may determine a compensation value for compensating each display and a luminance adjustment manner based on the compensation information, and then compensate the luminance of the primary display and/or the secondary display based on the compensation value and the luminance adjustment manner, so that the luminance of the primary display and the secondary display is consistent. During implementation, there are a plurality of manners in which luminance consistency between the primary display and the secondary display may be implemented. The following describes several possible adjustment manners by using an example in which the aging degree of the primary display is greater than the aging degree of the secondary display, that is, the actual luminance value of the primary display is less than the actual luminance value of the secondary display.

Manner c1: The luminance of the primary display is compensated, so that the luminance of the primary display is increased to be consistent with the luminance of the secondary display.

In an example, the first actual value of the luminance of the primary display is 400 nits, and the second actual value of the luminance of the secondary display is 450 nits. A maximum luminance value of the primary display may be increased from 400 nits to 450 nits by increasing a working current of the primary display, without changing a luminance setting value of the primary display. For example, a current working current of the primary display is 1 mA, a corresponding maximum luminance value is 400 nits, and a maximum luminance value corresponding to a working current of 1.2 mA is 450 nits. Therefore, the working current of the primary display may be adjusted to 1.2 mA, so that the maximum luminance value of the primary display is increased to 450 nits. In this way, the aging degrees of the primary display and the secondary display may be made consistent by adjusting the luminance of the primary display, that is, increasing the luminance of the primary display, so that luminance display effects of the primary display and the secondary display are consistent.

Manner c2: The luminance of the secondary display is compensated, so that the luminance of the secondary display is decreased to be consistent with the luminance of the primary display.

In an example, the first actual value of the luminance of the primary display is 400 nits, and the second actual value of the luminance of the secondary display is 450 nits. Working duration of the secondary display may be prolonged, to decrease a maximum luminance value of the secondary display from 450 nits to 400 nits. For example, when the luminance of the secondary display is set to 200 nits, it takes 24 hours to decrease the maximum luminance value of the secondary display by 50 nits. In this case, when the primary display is turned off (for example, in a charging scenario), the luminance of the secondary display may be set to 200 nits, and the secondary display continuously works for 24 hours at 200 nits, so that the maximum luminance value of the secondary display is decreased to 400 nits. In this way, when a user does not use the mobile phone, the mobile phone automatically adjusts the maximum luminance value of the secondary display without being perceived by the user, to make the aging degrees of the primary display and the secondary display consistent, so that luminance display effects of the primary display and the secondary display are consistent.

Manner c3: Both the luminance of the primary display and the luminance of the secondary display are compensated, to increase the luminance of the primary display and decrease the luminance of the secondary display, so that adjusted luminance of the primary display and the secondary display is consistent.

In a possible implementation, the display subsystem (DSS) may determine a first compensation value and a second compensation value based on the compensation information corresponding to the luminance. The luminance of the primary display is compensated based on the first compensation value, to increase the luminance of the primary display to a sum of the first actual value and the first compensation value; and the luminance of the secondary display is compensated based on the second compensation value, to decrease the luminance of the secondary display to a difference between the second actual value and the second compensation value. The sum of the first actual value and the first compensation value is equal to the difference between the second actual value and the second compensation value.

For example, the first actual value of the luminance of the primary display is 400 nits, the second actual value of the luminance of the secondary display is 450 nits, the first compensation value is 20 nits, and the second compensation value is 30 nits. That is, maximum luminance of the primary display is increased by 20 nits, and maximum luminance of the secondary display is decreased by 30 nits, so that the maximum luminance of the primary display and the maximum luminance of the secondary display may be consistent, and are both 420 nits.

In some embodiments, the display subsystem (DSS) determines a first current value corresponding to the sum of the first actual value and the first compensation value, and determines second working duration required for decreasing the luminance of the secondary display by the second compensation value. Then, the driver 340 configured to drive a display chip increases the working current of the primary display to the first current value, and prolongs the working duration of the secondary display by the second working duration. In this way, after the second working duration, adjusted luminance of the primary display and the secondary display may be consistent.

In a possible implementation, the prolonging the working duration of the secondary display by the second working duration may be specifically implemented in the following manner: when the secondary display is in a screen-off state, turning on the secondary display, and controlling working duration of the secondary display in a screen-on state to be the second working duration.

Further, to adjust the luminance of the secondary display in a scenario in which the user does not perceive the adjustment, so that luminance display effects of the primary display and the secondary display are consistent, the secondary display may be turned on in the following several cases:

In a first case, the mobile phone may detect a device status of the mobile phone, where the device status may include a static state or a motion state; and when the device status of the mobile phone is the static state and the secondary display is in the screen-off state, turn on the secondary display, and control the working duration of the secondary display in the screen-on state to be the second working duration.

In this case, for example, a gyro sensor and a gravity sensor may be used to collect device status data of the mobile phone, and then the device status of the mobile phone is determined. When the device status is the static state, the user may not use the mobile phone, for example, in a charging scenario, so that the luminance of the secondary display may be adjusted in a scenario in which the user does not perceive the adjustment.

In a second case, the mobile phone may detect ambient luminance of the mobile phone; and when detecting that ambient luminance of the secondary display is less than a preset threshold, turn on the secondary display, and control the working duration of the secondary display in the screen-on state to be the second working duration.

In this case, for example, an ambient light sensor may be used to detect the ambient luminance of the mobile phone. For example, in a dark night scenario, or in a scenario in which the mobile phone is placed in a bag or a pocket, or in a scenario in which the user places the mobile phone on a desktop for charging, and the secondary display is in contact with the desktop, the user generally does not use the secondary display in these scenarios, so that the luminance of the secondary display may be adjusted in a scenario in which the user does not perceive the adjustment.

In a third case, the mobile phone may collect statistics on use time data of the secondary display used by the user of the mobile phone, and determine, based on the use time data, a time segment in which the user does not use the secondary display; and in the time segment in which the user does not use the secondary display, turn on the secondary display, and control the working duration of the secondary display in the screen-on state to be the second working duration.

In a fourth case, the mobile phone may detect an orientation of the secondary display when the user holds the mobile phone. For example, a gyro sensor and an acceleration sensor detect that the secondary display faces away from the primary display. In this case, the secondary display may be turned on, and the working duration of the secondary display in the screen-on state may be controlled to be the second working duration.

In the foregoing several cases, there may be a plurality of implementations of turning on the secondary display. In a possible manner, the secondary display is turned on, and the luminance of the secondary display quickly reaches required luminance. In another possible manner, the secondary display may be turned on, and the luminance of the secondary display may be controlled to be gradually increased based on a preset luminance interval.

In some other embodiments, the maximum luminance of the primary display may be increased, and the maximum luminance of the secondary display may be adjusted by combining two manners. That is, the maximum luminance of the secondary display is increased by increasing a working current of the secondary display, and the maximum luminance of the secondary display is decreased by prolonging the working duration of the secondary display. Finally, adjusted maximum luminance of the secondary display is decreased relative to the maximum luminance of the secondary display before adjustment, so that adjusted maximum luminance of the primary display and the secondary display is consistent. For example, the display subsystem (DSS) determines a first current value corresponding to the sum of the first actual value and the first compensation value, and determines a second current value corresponding to a sum of the second actual value and a third compensation value; and determines second working duration required for decreasing the luminance of the secondary display from the sum of the second actual value and the third compensation value to the difference between the second actual value and the second compensation value. Then, the driver 340 configured to drive a display chip increases the working current of the primary display to the first current value, increases the working current of the secondary display to the second current value, and controls the working duration of the secondary display to be prolonged by the second working duration.

It should be noted that the controlling the working duration of the secondary display to be prolonged by the second working duration is similar to the prolonging the working duration of the secondary display by the second working duration. For details, refer to the foregoing related content of prolonging the working duration of the secondary display by the second working duration.

After the current statistical period ends, and after the luminance difference between the primary display and the secondary display is compensated for, adjusted luminance values at the end of the current statistical period are used as initial values of the primary display and the secondary display in a next statistical period, and use statistical data of the luminance of the primary display and the secondary display continues to be collected. In addition, at the end of the next statistical period, if there is a luminance difference between the primary display and the secondary display, the luminance difference between the primary display and the secondary display continues to be compensated for.

In the foregoing embodiment, an example in which a mura difference is the luminance difference between the primary display and the secondary display is used for description. When the mura difference is a color difference between the primary display and the secondary display, the to-be-measured parameter may be an RGB value or a gray scale, and the color difference between the primary display and the secondary display may be compensated for with reference to the foregoing related content of luminance compensation.

For example, the to-be-measured parameter is an RGB value. R values may be 0 to 255, G values may be 0 to 255, and B values may be 0 to 255. The color statistics collection module 312 may collect, in one statistical period, statistics on use duration corresponding to each level of R value, G value, and B value of the primary display and use duration corresponding to each level of R value, G value, and B value of the secondary display, and send the collected statistics on the use duration corresponding to each level of R value, G value, and B value of the primary display and the use duration corresponding to each level of R value, G value, and B value of the secondary display to the compensation calculation module 320.

Then, the compensation calculation module 320 calculates an average R use value, an average G use value, and an average B use value of the primary display in the statistical period. Refer to the following formulas (5) to (7):

$$\overline{R}_{primary} = \frac{R_1T_1 + R_2T_2 + \ldots + R_{n-1}T_{n-1} + R_nT_n}{T_1 + T_2 + \ldots + T_{n-1} + T_n} \ldots \quad \text{Formula (5)}$$

In formula (5), $\overline{R}_{primary}$ is the average R use value of the primary display in the statistical period; $R_1, R_2, \ldots, R_{n-1}$, and $R_n$ are respectively various levels of R values; and $T_1, T_2, \ldots, T_{n-1}$, and $T_n$ are respectively use duration of the primary display at various levels of R values, for example, $T_n$ is use duration of the primary display at $R_n$.

$$\overline{G}_{primary} = \frac{G_1T_1 + G_2T_2 + \ldots + G_{n-1}T_{n-1} + G_nT_n}{T_1 + T_2 + \ldots + T_{n-1} + T_n} \ldots \quad \text{Formula (6)}$$

In formula (6), $\overline{G}_{primary}$ is the average G use value of the primary display in the statistical period; $G_1, G_2, \ldots, G_{n-1}$, and $G_n$ are respectively various levels of G values; and $T_1, T_2, \ldots, T_{n-1}$, and $T_n$ are respectively use duration of the primary display at various levels of G values, for example, $T_n$ is use duration of the primary display at $G_n$.

$$\overline{B}_{primary} = \frac{B_1T_1 + B_2T_2 + \ldots + B_{n-1}T_{n-1} + B_nT_n}{T_1 + T_2 + \ldots + T_{n-1} + T_n} \ldots \quad \text{Formula (7)}$$

In formula (7), $\overline{B}_{primary}$ is the average B use value of the primary display in the statistical period; $B_1, B_2, \ldots, B_{n-1}$, and $B_n$ are respectively various levels of B values; and $T_1, T_2, \ldots, T_{n-1}$, and $T_n$ are respectively use duration of the primary display at various levels of B values, for example, $T_n$ is use duration of the primary display at $B_n$.

Then, the compensation calculation module 320 calculates an average R use value, an average G use value, and an average B use value of the secondary display in the statistical period. Refer to the following formulas (8) to (10):

$$\overline{R}_{secondary} = \frac{R_1T_1' + R_2T_2' + \ldots + R_{n-1}T_{n-1}' + R_nT_n'}{T_1' + T_2' + \ldots + T_{n-1}' + T_n'} \ldots \quad \text{Formula (8)}$$

In formula (8), $\overline{R}_{secondary}$ is the average R use value of the secondary display in the statistical period; $R_1, R_2, \ldots, R_{n-1}$, and $R_n$ are respectively various levels of R values; and $T_1', T_2', \ldots, T_{n-1}'$, and $T_n'$ are respectively use duration of the secondary display at various levels of R values, for example, $T_n'$ is use duration of the secondary display at $R_n$.

$$\overline{G}_{secondary} = \frac{G_1T_1' + G_2T_2' + \ldots + G_{n-1}T_{n-1}' + G_nT_n'}{T_1' + T_2' + \ldots + T_{n-1}' + T_n'} \ldots \quad \text{Formula (9)}$$

In formula (9), $\overline{G}_{secondary}$ is the average G use value of the secondary display in the statistical period; $G_1, G_2, \ldots, G_{n-1}$, and $G_n$ are respectively various levels of G values; and $T_1', T_2', \ldots, T_{n-1}'$, and $T_n'$ are respectively use duration of the secondary display at various levels of G values, for example, $T_n'$ is use duration of the secondary display at $G_n$.

$$\overline{B}_{secondary} = \frac{B_1T_1' + B_2T_2' + \ldots + B_{n-1}T_{n-1}' + B_nT_n'}{T_1' + T_2' + \ldots + T_{n-1}' + T_n'} \ldots \quad \text{Formula (10)}$$

In formula (10), $\overline{B}_{secondary}$ is the average B use value of the secondary display in the statistical period; $B_1, B_2, \ldots, B_{n-1}$, and $B_n$ are respectively various levels of B values; and $T_1', T_2', \ldots, T_{n-1}'$, and $T_n'$ are respectively use duration of the secondary display at various levels of B values, for example, $T_n'$ is use duration of the secondary display at $B_n$.

Then, based on $\overline{R}_{primary}$ calculated based on formula (5) and a first correspondence, the compensation calculation module 320 may determine a first actual value of an R value of the primary display at the end of the current statistical period. The first correspondence includes a correspondence between an average R use value and an actual value of the primary display. Similarly, based on $\overline{R}_{secondary}$ calculated based on formula (8) and a second correspondence, the compensation calculation module 320 may determine a second actual value of an R value of the secondary display at the end of the current statistical period. The second correspondence includes a correspondence between an average R use value and an actual value of the secondary display.

After determining the first actual value of the R value of the primary display at the end of the current statistical period and the second actual value of the R value of the secondary display at the end of the current statistical period, the compensation calculation module 320 may determine, based on the first actual value and the second actual value, compensation information corresponding to the R value. A manner of determining the compensation information corresponding to the R value is similar to the manner of determining the compensation information corresponding to the luminance. For details, refer to the foregoing related content of the manner b1 or b2. Details are not described herein.

After the compensation calculation module 320 determines the R value compensation information between the primary display and the secondary display, the display subsystem (DSS) 330 may determine a compensation value for compensating each display and an R value adjustment manner based on the R value compensation information, and then compensate the R values of the primary display and/or the secondary display based on the compensation value and the R value adjustment manner, so that the R values of the primary display and the secondary display are consistent. A manner of adjusting the R values of the primary display and the secondary display is similar to the manner of adjusting the luminance of the primary display and the secondary display. For details, refer to the foregoing related content of the manner c1, c2, or c3. Details are not described herein.

In the foregoing embodiment, when the mura difference is a color difference between the primary display and the secondary display, the to-be-measured parameter may alternatively be represented by using gray scale information. Values of various levels of gray scales are 0 to 255. The color statistics collection module 312 may collect, in one statistical period, statistics on use duration corresponding to each level of gray scale of the primary display and use duration corresponding to each level of gray scale of the secondary display, and send the collected statistics on the use duration corresponding to each level of gray scale of the primary display and the use duration corresponding to each level of gray scale of the secondary display to the compensation calculation module 320.

The compensation calculation module 320 may calculate an average gray scale use value of the primary display in the statistical period. Refer to the following formula (11):

$$\bar{g}_{primary} = \frac{g_1T_1 + g_2T_2 + \ldots + g_{n-1}T_{n-1} + g_nT_n}{T_1 + T_2 + \ldots + T_{n-1} + T_n} \ldots \quad \text{Formula (11)}$$

In formula (11), $\bar{g}_{primary}$ is the average gray scale use value of the primary display in the statistical period; $g_1$, $g_2$, . . . , $g_{n-1}$, and $g_n$ are respectively various levels of gray scale values; and $T_1$, $T_2$, . . . , $T_{n-1}$ and $T_n$ are respectively use duration of the primary display at various levels of gray scale values, for example, $T_n$ is use duration of the primary display at a gray scale $g_n$.

Then, based on the average gray scale use value $\bar{g}_{primary}$ of the primary display calculated based on formula (11) and a first correspondence between gray scales, the compensation calculation module 320 may determine a first actual value of a gray scale of the primary display at the end of the current statistical period. The first correspondence between gray scales includes a correspondence between an average gray scale use value and an actual gray scale value of the primary display. Similarly, based on a calculated average gray scale use value $\bar{g}_{secondary}$ of the secondary display and a second correspondence between gray scales, the compensation calculation module 320 may determine a second actual value of a gray scale of the secondary display at the end of the current statistical period. The second correspondence includes a correspondence between an average gray scale use value and an actual gray scale value of the secondary display.

After determining the first actual value of the gray scale of the primary display at the end of the current statistical period and the second actual value of the gray scale of the secondary display at the end of the current statistical period, the compensation calculation module 320 may determine, based on the first actual value of the gray scale and the second actual value of the gray scale, compensation information corresponding to the gray scale. A manner of determining the compensation information corresponding to the gray scale is similar to the manner of determining the compensation information corresponding to the luminance. For details, refer to the foregoing related content of the manner b1 or b2. Details are not described herein.

After the compensation calculation module 320 determines the gray scale compensation information between the primary display and the secondary display, the display subsystem (DSS) 330 may determine a compensation value for compensating each display and the gray scale adjustment manner based on the gray scale compensation information, and then compensate the R values of the primary display and/or the secondary display based on the compensation value and the gray scale adjustment manner, so that the R values of the primary display and the secondary display are consistent.

In a possible implementation, an R component, a G component, and a B component that are corresponding to a target value of the gray scale may be determined based on the first actual value of the gray scale of the primary display and the second actual value of the gray scale of the secondary display at the end of the current statistical period; a first R component difference, a first G component difference, and a first B component difference between the target value of the gray scale and the first actual value of the gray scale may be determined as a first compensation value; and a second R component difference, a second G component difference, and a second B component difference between the target value of the gray scale and the second actual value of the gray scale may be determined as a second compensation value. Then, the first R component difference is used to compensate an R component value corresponding to the first actual value, the first G component difference is used to compensate a G component value corresponding to the first actual value, the first B component difference is used to compensate a B component value corresponding to the first actual value, the second R component difference is used to compensate an R component value corresponding to the second actual value, the second G component difference is used to compensate a G component value corresponding to the second actual value, and the second B component difference is used to compensate a B component value corresponding to the second actual value. RGB components corresponding to the first actual value of the gray scale of the first display and RGB components corresponding to the actual value of the gray scale of the second display are separately compensated by adjusting the RGB components, so that gray scale display effects of the first display and the second display are consistent.

In another possible implementation, the to-be-measured parameter is the gray scale. An R component, a G component, and a B component that are corresponding to a compensation target value of the gray scale are determined; and the R component, the G component, and the B component that are corresponding to the compensation target value of the gray scale are separately written into a first register configured to control the gray scale of the first display and a second register configured to control the gray scale of the secondary display.

Figure 4:
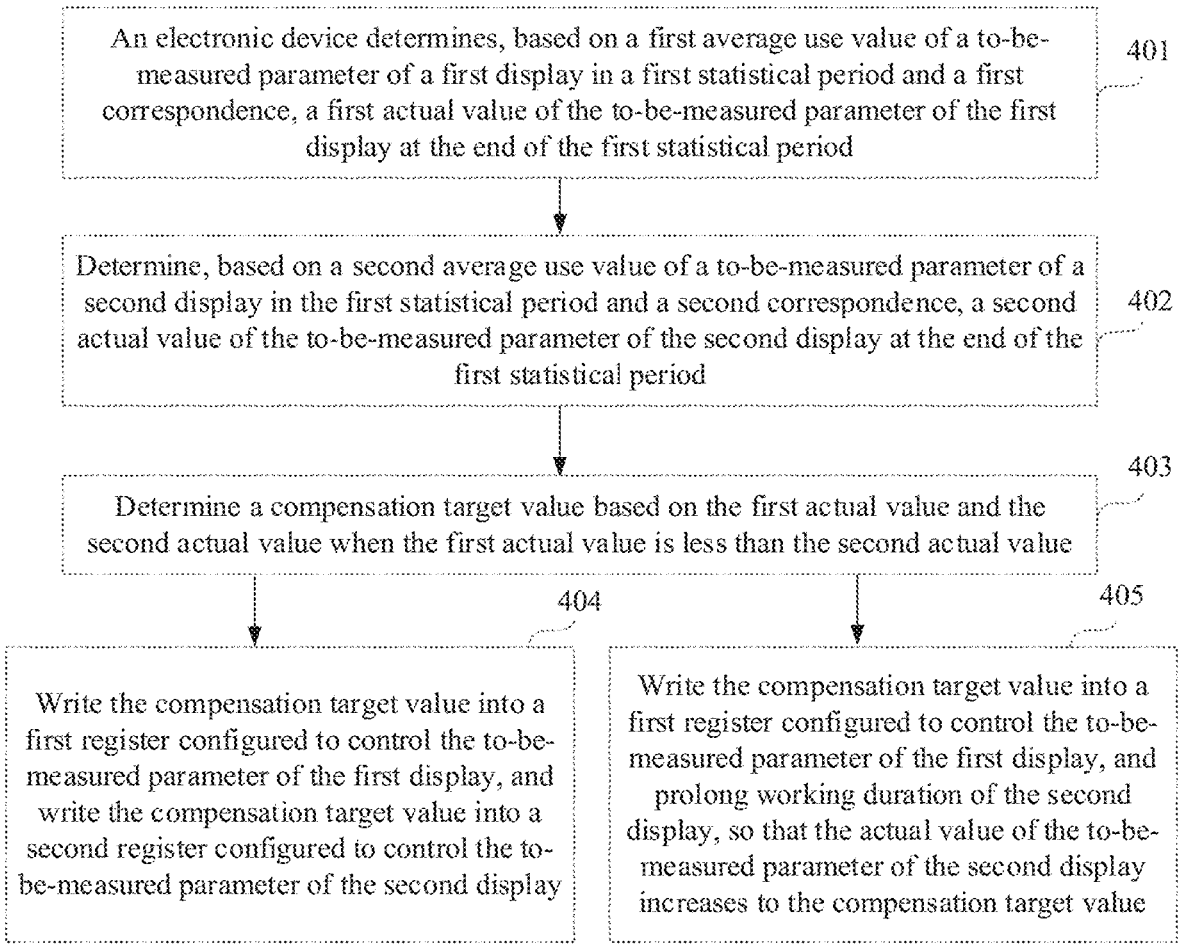
FIG. 4 is a schematic diagram of a compensation method according to an embodiment of this application.

With reference to the foregoing embodiments and related accompanying drawings, an embodiment of this application provides a compensation method. The method may be implemented in the electronic device shown in FIG. 1A to FIG. 1C or another electronic device with a foldable display. As shown in FIG. 4, the method may include the following steps.

Step 401: The electronic device determines, based on a first average use value of a to-be-measured parameter of a first display in a first statistical period and a first correspondence, a first actual value of the to-be-measured parameter of the first display at the end of the first statistical period.

For example, the first display may be the primary display in the foregoing embodiments, and a second display may be the secondary display in the foregoing embodiments. The first actual value may be the first actual value in the foregoing example with reference to FIG. 3, and maximum luminance of the first display is used as an example for description.

Step 402: Determine, based on a second average use value of a to-be-measured parameter of the second display in the first statistical period and a second correspondence, a second actual value of the to-be-measured parameter of the second display at the end of the first statistical period.

For example, if the first actual value refers to the maximum luminance of the first display, the second actual value refers to maximum luminance of the second display. The second actual value may be the second actual value in the foregoing example with reference to FIG. 3, and the maximum luminance of the second display is used as an example for description.

Step 403: Determine a compensation target value based on the first actual value and the second actual value when the first actual value is less than the second actual value. Then, step 404 or step 405 may be performed.

It should be understood that the first actual value may be the maximum luminance of the first display, half of the maximum luminance of the first display, or another value, and the second actual value may be the maximum luminance of the second display, half of the maximum luminance of the second display, or another value, provided that the maximum luminance of the first display may be adjusted to be consistent with the maximum luminance of the second display by using the compensation target value determined based on the first actual value and the second actual value.

Step 404: Write the compensation target value into a first register configured to control the to-be-measured parameter of the first display, and write the compensation target value into a second register configured to control the to-be-measured parameter of the second display.

Step 405: Write the compensation target value into a first register configured to control the to-be-measured parameter of the first display, and prolong working duration of the second display, so that the actual value of the to-be-measured parameter of the second display is consistent with the actual value of the to-be-measured parameter of the first display.

Based on the solution, the electronic device may separately determine the actual values of the first display and the second display by using statistical data. Then, for the first display whose actual value of the to-be-measured parameter is relatively low, a maximum value of the to-be-measured parameter is increased by writing the compensation target value into the first register; and for the second display whose actual value of the to-be-measured parameter is relatively high, a maximum value of the to-be-measured parameter is decreased by writing the compensation target value into the second register, so that the maximum values of the to-be-measured parameters of the first display and the second display may be consistent. For the second display whose actual value of the to-be-measured parameter is relatively high, the maximum values of the first display and the second display may alternatively be made consistent by prolonging the working duration. In this way, a difference between the to-be-measured parameters of the first display and the second display may be reduced, so that display effects of different displays are consistent.

Further, optionally, step 401 may be implemented in the following manner: The electronic device may obtain first use statistical data corresponding to the to-be-measured parameter of the first display in the first statistical period, and determine, based on the first use statistical data, the first average use value of the to-be-measured parameter of the first display in the first statistical period; and then determine the first actual value based on the first average use value and the first correspondence, where the first correspondence includes a correspondence between an average use value and an actual value of the to-be-measured parameter of the first display. In this way, the electronic device may periodically collect use statistical data of the to-be-measured parameter of the first display, and then may accurately determine, based on the first correspondence, an actual value of the to-be-measured parameter of the first display at the end of a statistical period.

Further, optionally, step 402 may be implemented in the following manner: The electronic device may obtain second use statistical data corresponding to the to-be-measured parameter of the second display in the first statistical period, and determine, based on the second use statistical data, the second average use value of the to-be-measured parameter of the second display in the first statistical period; and then determine the second actual value based on the second average use value and the second correspondence, where the second correspondence includes a correspondence between an average use value and an actual value of the to-be-measured parameter of the second display. In this way, the electronic device may periodically collect use statistical data of the to-be-measured parameter of the second display, and then may accurately determine, based on the second correspondence, an actual value of the to-be-measured parameter of the second display at the end of a statistical period.

In a possible implementation, if the to-be-measured parameter is luminance, the writing the compensation target value into a first register configured to control the to-be-measured parameter of the first display may include: determining a first current value corresponding to the compensation target value, and increasing a working current of the first display to the first current value; and triggering, by using the first current value, a driver IC of the first display to write the compensation target value into the first register. In this manner, the electronic device may adjust the working current of the first display with relatively low actual luminance, to increase the luminance of the first display, so that display effects of the first display and the second display are consistent.

In a possible implementation, the to-be-measured parameter is luminance. The writing the compensation target value into a second register configured to control the to-be-measured parameter of the second display includes: determining a second current value corresponding to the compensation target value, and decreasing a working current of the second display to the second current value; and triggering, by using the second current value, a driver IC of the second display to write the compensation target value into the second register. In this manner, the electronic device may adjust the working current of the second display with relatively high actual luminance, to decrease the luminance of the second display, so that display effects of the first display and the second display are consistent.

In a possible implementation, the to-be-measured parameter is luminance. The prolonging working duration of the second display, so that the actual value of the to-be-measured parameter of the second display is consistent with the actual value of the to-be-measured parameter of the first display includes: determining first working duration required for decreasing the second actual value to the compensation target value when luminance of the second display is set to preset luminance; and prolonging the working duration of the second display by the first working duration. In this manner, the electronic device may adjust the working duration of the second display with relatively high actual luminance, to decrease the luminance of the second display, so that display effects of the first display and the second display are consistent.

Further, the prolonging the working duration of the second display by the first working duration may be implemented in the following manner: when the second display is in a screen-off state, turning on the second display, and controlling working duration of the second display in a screen-on state to be the first working duration. In this way, the luminance of the second display may be adjusted when a user does not use the second display, so that the user can use the second display without being affected.

Further, to adjust the luminance of the second display in a scenario in which the user does not perceive the adjustment, so that luminance display effects of the first display and the second display are consistent, the second display may be turned on in the following several cases:

In a first case, the electronic device may detect a device status of the electronic device, where the device status may include a static state or a motion state; and when the device status of the electronic device is the static state and the second display is in the screen-off state, turn on the second display, and control the working duration of the second display in the screen-on state to be the first working duration.

In this case, for example, a gyro sensor and a gravity sensor may be used to collect device status data of the electronic device, and then the device status of the electronic device is determined. When the device status is the static state, the user may not use the electronic device, for example, in a charging scenario, so that the luminance of the second display may be adjusted in a scenario in which the user does not perceive the adjustment.

In a second case, the electronic device may detect ambient luminance of the electronic device; and when detecting that ambient luminance of the second display is less than a preset threshold, turn on the second display, and control the working duration of the second display in the screen-on state to be the first working duration.

In this case, for example, an ambient light sensor may be used to detect the ambient luminance of the electronic device. For example, in a dark night scenario, or in a scenario in which the electronic device is placed in a bag or a pocket, or in a scenario in which the user places the electronic device on a desktop for charging, and the second display is in contact with the desktop, the user generally does not use the second display in these scenarios, so that the luminance of the second display may be adjusted in a scenario in which the user does not perceive the adjustment.

In a third case, the electronic device may collect statistics on use time data of the second display used by the user of the electronic device, and determine, based on the use time data, a time segment in which the user does not use the second display; and in the time segment in which the user does not use the second display, turn on the second display, and control the working duration of the second display in the screen-on state to be the first working duration.

In a fourth case, the electronic device may detect an orientation of the second display when the user holds the electronic device. For example, a gyro sensor and an acceleration sensor detect that the second display faces away from the first display. In this case, the second display may be turned on, and the working duration of the second display in the screen-on state may be controlled to be the first working duration.

In the foregoing several cases, there may be a plurality of implementations of turning on the second display. In a possible manner, the second display is turned on, and the luminance of the second display quickly reaches required luminance. In another possible manner, the second display may be turned on, and the luminance of the second display may be controlled to be gradually increased based on a preset luminance interval.

In a possible implementation, the to-be-measured parameter is a gray scale. The writing the compensation target value into a first register configured to control the to-be-measured parameter of the first display, and writing the compensation target value into a second register configured to control the to-be-measured parameter of the second display may be implemented in the following manner: determining an R component, a G component, and a B component that are corresponding to a compensation target value of the gray scale; and separately writing the R component, the G component, and the B component that are corresponding to the compensation target value of the gray scale into the first register and the second register. In this way, RGB components corresponding to a first actual value of a gray scale of the first display and RGB components corresponding to an actual value of a gray scale of the second display may be separately compensated by adjusting the RGB components, so that gray scale display effects of the first display and the second display are consistent.

It should be noted that, in the foregoing embodiment, only an example in which the electronic device includes two displays is used to describe compensation for a mura difference between the two displays in detail. When the electronic device includes a plurality of displays, a mura difference between each two of the plurality of displays may be determined, and compensation may be performed until there is no mura difference between all displays included in the electronic device.

Further, when there is a mura difference between two displays, that the to-be-measured parameter is luminance is used as an example, and a luminance difference between the primary display and the secondary display may alternatively be more carefully compensated for. For example, display areas of the primary display and the secondary display are separately divided into N areas, and luminance of an area A of the primary display and luminance of an area B that has a positional correspondence with the area A and that is on the secondary display are separately compensated, so that the luminance of the area A and the area B is consistent.

For example, a display area of the first display is divided into N first areas, a display area of the second display is divided into N second areas, and N is a positive integer. Step 401 may be implemented in the following manner: determining, based on a first average use value of a to-be-measured parameter of each of the N first areas in the first statistical period and the first correspondence, a first actual value of the to-be-measured parameter of each first area at the end of the first statistical period. Step 402 may be implemented in the following manner: determining, based on a second average use value of a to-be-measured parameter of each of the N second areas in the first statistical period and the second correspondence, a second actual value of the to-be-measured parameter of each second area at the end of the first statistical period. Step 403 may be implemented in the following manner: for each of the N first areas, determining a second area that has a positional correspondence with the first area, and determining the compensation target value based on a first actual value of the first area and a second actual value of the second area that has the positional correspondence with the first area. Step 404 or step 405 may be implemented in the following manner: writing the compensation target value into a first register configured to control the to-be-measured parameter of the first area, and writing the compensation target value into a second register configured to control a to-be-measured parameter of the second area that has the positional correspondence with the first area; or writing the compensation target value into a first register configured to control the to-be-measured parameter of the first area, and prolonging working duration of the second area that has the positional correspondence with the first area, so that an actual value of a to-be-measured parameter of the second area that has the positional correspondence with the first area is consistent with the actual value of the to-be-measured parameter of the first area.

It should be noted that, for the areas separately divided for the first display and the second display, working circuits of any two areas may be separately adjusted, to adjust the to-be-measured parameters of the displays by areas.

Figure 5:
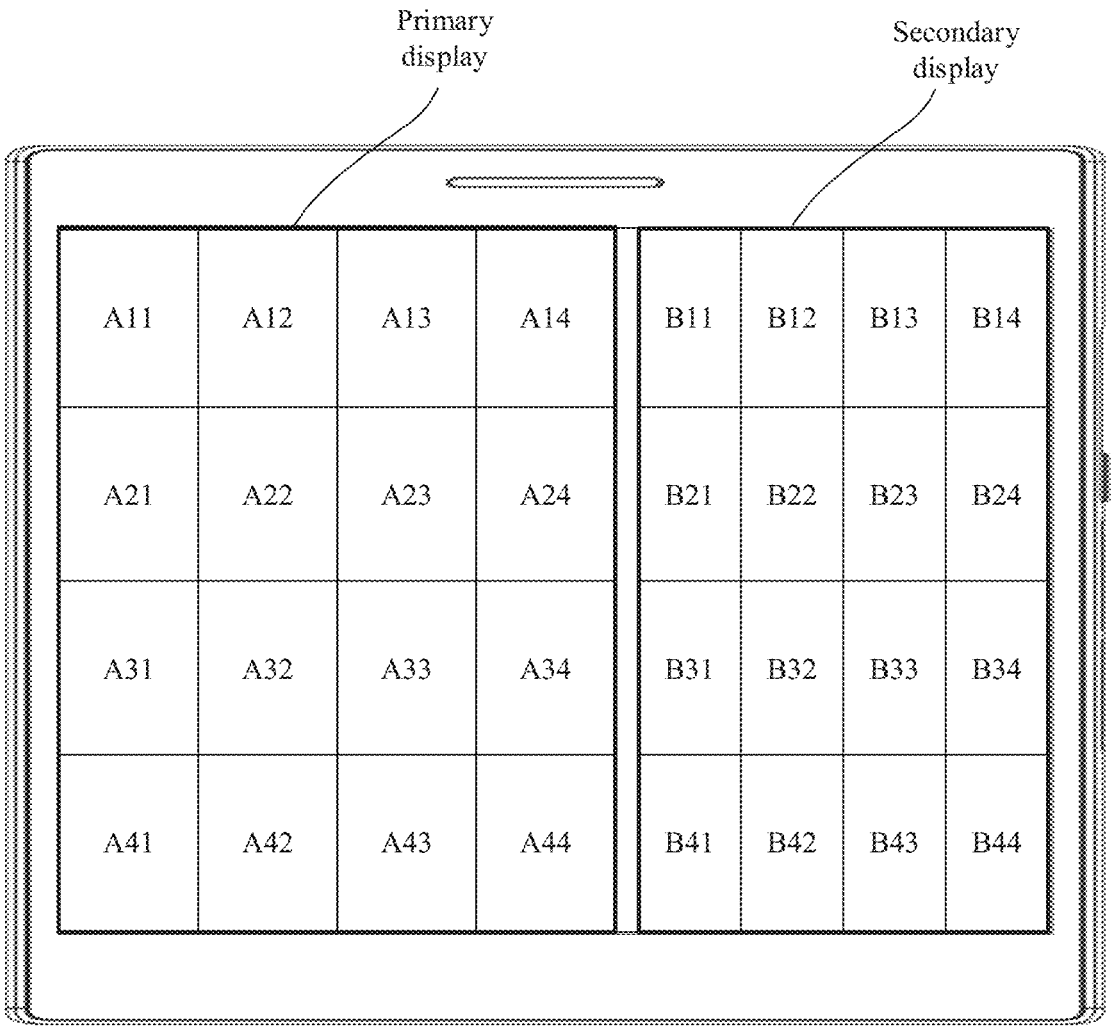
FIG. 5 is a schematic diagram of area division of a display according to an embodiment of this application.

For example, N is 16. Referring to FIG. 5, the display area of the primary display is divided into 16 areas, which are respectively an area A11, an area A12, an area A13, an area A14, an area A21, an area A22, an area A23, an area A24, an area A31, an area A32, an area A33, an area A34, an area A41, an area A42, an area A43, and an area A44. The display area of the secondary display is divided into 16 areas, which are respectively an area B11 corresponding to the area A11, an area B12 corresponding to the area A12, an area B13 corresponding to the area A13, an area B14 corresponding to the area A14, an area B21 corresponding to the area A21, an area B22 corresponding to the area A22, an area B23 corresponding to the area A23, an area B24 corresponding to the area A24, an area B31 corresponding to the area A31, an area B32 corresponding to the area A32, an area B33 corresponding to the area A33, an area B34 corresponding to the area A34, an area B41 corresponding to the area A41, an area B42 corresponding to the area A42, an area B43 corresponding to the area A43, and an area B44 corresponding to the area A44.

The area A11 the primary display and the area B11 of the secondary display are used as an example. A specific process of implementing the compensation method may be: first determining, based on a first average use value of a to-be-measured parameter of the area A11 in the first statistical period and the first correspondence a first actual value of the to-be-measured parameter of the area A11 at the end of the first statistical period; determining, based on a second average use value of a to-be-measured parameter of the area B11 in the first statistical period and the second correspondence, a second actual value of the to-be-measured parameter of the area B11 at the end of the first statistical period; then determining a compensation target value based on the first actual value of the area A11 and the second actual value of the area B11; and writing the compensation target value into a first register configured to control the to-be-measured parameter of the area A11, and writing the compensation target value into a second register configured to control the to-be-measured parameter of the area B11; or writing the compensation target value into a first register configured to control the to-be-measured parameter of the area A11, and prolonging working duration of the area B11, so that the actual value of the to-be-measured parameter of the area B11 is consistent with the actual value of the to-be-measured parameter of the area A11.

It should be noted that, for determining the first actual value of the area A11 and the second actual value of the area B11, refer to the related content of determining the actual values respectively corresponding to the two displays in the foregoing embodiment; for writing the compensation target value into a register corresponding to a corresponding area, refer to the related content of writing the compensation target value into a register corresponding to a corresponding display; and for prolonging the working duration of the area B11, refer to the related content of prolonging the working duration of the second display. Details are not described herein.

In the foregoing embodiments provided in this application, the method provided in the embodiments of this application is described from a perspective in which the electronic device (the mobile phone 100) serves as an execution body. To implement functions in the method provided in the foregoing embodiments of this application, the terminal device may include a hardware structure and/or a software module, to implement the functions in a form of the hardware structure, the software module, or both the hardware structure and the software module. Whether a function in the foregoing functions is performed by the hardware structure, the software module, or the combination of the hardware structure and the software module depends on particular applications and design constraints of the technical solutions.

According to the context, the term "when" used in the foregoing embodiments may be interpreted as a meaning of "if", "after", "in response to determining", or "in response to detecting". Similarly, according to the context, the phrase "when it is determined that" or "if (a stated condition or event) is detected" may be interpreted as a meaning of "if it is determined that", "in response to determining", "when (a stated condition or event) is detected", or "in response to detecting (a stated condition or event)".

All or some of the foregoing embodiments may be implemented by using software, hardware, firmware, or any combination thereof. When the software is used to implement the embodiments, all or some of the embodiments may be implemented in a form of a computer program product. The computer program product includes one or more computer instructions. When the computer program instructions are loaded and executed on a computer, all or some of the procedures or functions according to the embodiments of this application are generated. The computer may be a general-purpose computer, a dedicated computer, a computer network, or another programmable apparatus. The computer instructions may be stored in a computer-readable storage medium or may be transmitted from a computer-readable storage medium to another computer-readable storage medium. For example, the computer instructions may be transmitted from a website, computer, server, or data center to another website, computer, server, or data center in a wired (for example, a coaxial cable, an optical fiber, or a digital subscriber line) or wireless (for example, infrared, radio, or microwave) manner. The computer-readable storage medium may be any usable medium accessible by a computer, or a data storage device, for example, a server or a data center, integrating one or more usable media. The usable medium may be a magnetic medium (for example, a floppy disk, a hard disk, or a magnetic tape), an optical medium (for example, a DVD), a semiconductor medium (for example, a solid-state drive), or the like.

For a purpose of explanation, the foregoing description is described with reference to a specific embodiment. However, the foregoing example discussion is not intended to be detailed, and is not intended to limit this application to a disclosed precise form. Based on the foregoing teaching content, many modification forms and variation forms are possible. Embodiments are selected and described to fully illustrate the principles of this application and practical application of the principles, so that other persons skilled in the art can make full use of this application and various embodiments that have various modifications applicable to conceived specific usage.

What is claimed is:

1. A method implemented by an electronic device, wherein the method comprises:

determining, based on a first average use value of a first to-be-measured parameter of a first display in a first statistical period and based on a first correspondence, a first actual value of the first to-be-measured parameter at an end of the first statistical period, wherein the first display belongs to a foldable display of the electronic device, wherein the first average use value is an average value of the first to-be-measured parameter at a plurality of first time intervals within the first statistical period;

determining, based on a second average use value of a second to-be-measured parameter of a second display of the foldable display in the first statistical period and based on a second correspondence, a second actual value of the second to-be-measured parameter at the end of the first statistical period, wherein the second average use value is an average value of the second to-be-measured parameter at a plurality of second time intervals within the first statistical period, and wherein the correspondence is a correspondence relation established based on historic data between a plurality of average values of the first to-be-measured parameter and the second to-be-measured parameter calculated over respective time periods equal to the first statistical period and a plurality of respective actual values of the first to-be-measured parameter and the second to-be-measured parameter at respective ends of the time periods;

determining a compensation target value based on the first actual value and the second actual value when the first actual value is less than the second actual value; and performing one of:

writing the compensation target value into a first register configured to control the first to-be-measured parameter and a second register configured to control the second to-be-measured parameter; or writing the compensation target value into the first register and prolonging a working duration of the second display to make the second actual value consistent with the first actual value.

2. The method of claim 1, wherein the first to-be-measured parameter is luminance, wherein the second to-be-measured parameter is luminance, and wherein the method further comprises:

determining a first current value corresponding to the compensation target value;

increasing a working current of the first display to the first current value; and triggering, using the first current value, a driver integrated circuit (IC) of the first display to write the compensation target value into the first register.

3. The method of claim 1, wherein the first to-be-measured parameter is luminance, wherein the second to-be-measured parameter is luminance, and wherein the method further comprises:

determining a second current value corresponding to the compensation target value;

decreasing a working current of the second display to the second current value; and triggering, using the second current value, a driver integrated circuit (IC) of the second display to write the compensation target value into the second register.

4. The method of claim 1, wherein the first to-be-measured parameter is luminance, wherein the second to-be-measured parameter is luminance, and wherein the method further comprises:

determining a first working duration for decreasing the second actual value to the compensation target value when luminance of the second display is set to a preset luminance; and prolonging the working duration by the first working duration.

5. The method of claim 4, wherein when the second display is in a screen-off state, the method further comprises:

turning on the second display; and controlling the working duration in a screen-on state to be the first working duration.

6. The method of claim 5, comprising:

detecting a device status of the electronic device, wherein the device status comprises a static state or a motion state;

identifying that the device status is the static state and the second display is in the screen-off state;

further turning on the second display and further controlling the working duration in the screen-on state to be the first working duration in response to identifying that the device status is the static state and the second display is in the screen-off state.

7. The method of claim 5, comprising:

detecting a first ambient luminance of the electronic device;

detecting that a second ambient luminance of the second display is less than a preset threshold; and further turning on the second display and further controlling the working duration in the screen-on state to be the first working duration in response to detecting that the second ambient luminance is less than the preset threshold.

8. The method of claim 5, wherein before turning on the second display and controlling the working duration in the screen-on state to be the first working duration, the method further comprises:

collecting statistics on use time data of the second display used by a user of the electronic device;

determining, based on the use time data, a time segment in which the user does not use the second display; and further turning on the second display and further controlling the working duration in the screen-on state to be the first working duration during the time segment.

9. The method of claim 5, further comprising further turning on the second display and further controlling the luminance of the second display to be gradually increased based on a preset luminance interval.

10. The method of claim 1, wherein the first to-be-measured parameter is a first gray scale, wherein the second to-be-measured parameter is a second gray scale, and wherein the method further comprises:

determining a first R component, a first G component, and a first B component corresponding to a first compensation target value of the first gray scale;

determining a second R component, a second G component, and a second B component corresponding to a second compensation target value of the second gray scale;

writing the first R component, the first G component, and the first B component into the first register; and writing the second R component, the second G component, and the second B component into the second register.

11. The method of claim 1, wherein a first display area of the first display is divided into N first areas, wherein a second display area of the second display is divided into N second areas, wherein N is a positive integer, and wherein the method further comprises:

determining, based on a third average use value of a third to-be-measured parameter of each of the N first areas in the first statistical period and the first correspondence, a third actual value of the third to-be-measured parameter at the end of the first statistical period;

determining, based on a fourth average use value of a fourth to-be-measured parameter of each of the N second areas in the first statistical period and the second correspondence, a fourth actual value of the fourth to-be-measured parameter at the end of the first statistical period; and performing for each of the N first areas:

determining a second area that has a positional correspondence with a corresponding first area;

determining the compensation target value based on a fifth actual value of the corresponding first area and a sixth actual value of the second area; and performing one of:

writing the compensation target value into a third register configured to control a fifth to-be-measured parameter of the corresponding first area and a fourth register configured to control a sixth to-be-measured parameter of the second area; or writing the compensation target value into the third register and prolonging a second working duration of the second area to make a seventh actual value of the sixth to-be-measured parameter consistent with an eighth actual value of the fifth to-be-measured parameter.

12. An electronic device comprising:

a display comprising a first display and a second display;

a memory configured to store instructions; and one or more processors coupled to the display and the memory, wherein when executed by the one or more processors, the instructions cause the electronic device to:

determine, based on a first average use value of a first to-be-measured parameter of the first display in a first statistical period and based on a first correspondence, a first actual value of the first to-be-measured parameter at an end of the first statistical period, wherein the first average use value is an average value of the first to-be-measured parameter at a plurality of first time intervals within the first statistical period;

determine, based on a second average use value of a second to-be-measured parameter of the second display in the first statistical period and based on a second correspondence, a second actual value of the second to-be-measured parameter at the end, wherein the second average use value is an average value of the second to-be-measured parameter at a plurality of second time intervals within the first statistical period, and wherein the correspondence is a correspondence relation established based on historic data between a plurality of average values of the first to-be-measured parameter and the second to-be-measured parameter calculated over respective time periods equal to the first statistical period and a plurality of respective actual values of the first to-be-measured parameter and the second to-be-measured parameter at respective ends of the time periods;

determine a compensation target value based on the first actual value and the second actual value when the first actual value is less than the second actual value; and perform one of:

write the compensation target value into a first register configured to control the first to-be-measured parameter and a second register configured to control the second to-be-measured parameter; or write the compensation target value into the first register and prolong a working duration of the second display to make the second actual value consistent with the first actual value.

13. The electronic device of claim 12, wherein the first to-be-measured parameter is luminance, wherein the second to-be-measured parameter is luminance, and wherein when executed by the one or more processors, the instructions further cause the electronic device to:

determine a first current value corresponding to the compensation target value;

increase a working current of the first display to the first current value; and trigger, using the first current value, a driver integrated circuit (IC) of the first display to write the compensation target value into the first register.

14. The electronic device of claim 12, wherein the first to-be-measured parameter is luminance, wherein the second to-be-measured parameter is luminance, and wherein when executed by the one or more processors, the instructions further cause the electronic device to:

determine a second current value corresponding to the compensation target value;

decrease a working current of the second display to the second current value; and trigger, using the second current value, a driver integrated circuit (IC) of the second display to write the compensation target value into the second register.

15. The electronic device of claim 12, wherein the first to-be-measured parameter is luminance, wherein the second to-be-measured parameter is luminance, and wherein when executed by the one or more processors, the instructions further cause the electronic device to:

determine a first working duration for decreasing the second actual value to the compensation target value when luminance of the second display is set to a preset luminance; and prolong the working duration by the first working duration.

16. The electronic device of claim 15, wherein when the second display is in a screen-off state and when executed by the one or more processors, the instructions further cause the electronic device to:

turn on the second display; and control the working duration in a screen-on state to be the first working duration.

17. The electronic device of claim 16, wherein when executed by the one or more processors, the instructions further cause the electronic device to:

detect a device status of the electronic device, wherein the device status comprises a static state or a motion state;

identify that the device status is the static state and the second display is in the screen-off state; and further turn on the second display and further control the working duration in the screen-on state to be the first working duration in response to identifying that the device status is the static state and the second display is in the screen-off state.

18. The electronic device of claim 16, wherein when executed by the one or more processors, the instructions further cause the electronic device to:

detect a first ambient luminance of the electronic device;

detect that a second ambient luminance of the second display is less than a preset threshold; and further turn on the second display and further control the working duration in the screen-on state to be the first working duration in response to detecting that the second ambient luminance is less than the preset threshold.

19. The electronic device of claim 16, wherein before turning on the second display and controlling the working duration in the screen-on state to be the first working duration, when executed by the one or more processors, the instructions further cause the electronic device to:

collect statistics on use time data of the second display used by a user of the electronic device;

determine, based on the use time data, a time segment in which the user does not use the second display; and further turn on the second display and further control the working duration in the screen-on state to be the first working duration during the time segment.

20. A computer program product comprising computer-executable instructions that are stored on a non-transitory computer-readable medium and that, when executed by one or more processors, cause an electronic device to:

determine, based on a first average use value of a first to-be-measured parameter of a first display of a foldable display in a first statistical period and based on a first correspondence, a first actual value of the first to-be-measured parameter at an end of the first statistical period, wherein the foldable display is of the electronic device, wherein the first average use value is an average value of the first to-be-measured parameter at a plurality of first time intervals within the first statistical period;

determine, based on a second average use value of a second to-be-measured parameter of a second display of the foldable display in the first statistical period and based on a second correspondence, a second actual value of the second to-be-measured parameter at the end, wherein the second average use value is an average value of the second to-be-measured parameter at a plurality of second time intervals within the first statistical period, and wherein the correspondence is a correspondence relation established based on historic data between a plurality of average values of the first to-be-measured parameter and the second to-be-measured parameter calculated over respective time periods equal to the first statistical period and a plurality of respective actual values of the first to-be-measured parameter and the second to-be-measured parameter at respective ends of the time periods;

determine a compensation target value based on the first actual value and the second actual value when the first actual value is less than the second actual value; and perform one of:

write the compensation target value into a first register configured to control the first to-be-measured parameter and a second register configured to control the second to-be-measured parameter; or write the compensation target value into the first register and prolong a working duration of the second display to make the second actual value consistent with the first actual value.

* * * * *